United States Patent [19]

Ohlsson et al.

[11] Patent Number: 4,646,507

[45] Date of Patent: Mar. 3, 1987

[54] MACHINE FOR MAKING PACKS FOR FLOWING MATERIAL

[75] Inventors: Ingemar Ohlsson, Malmö ; Göran Larsson, Dalby, both of Sweden

[73] Assignee: Tetra Pak Developpement S.A., Pully-Lausanne, Switzerland

[21] Appl. No.: 740,058

[22] Filed: May 31, 1985

[30] Foreign Application Priority Data

Jun. 2, 1984 [DE] Fed. Rep. of Germany ..... 3420711

[51] Int. Cl.[4] ..... B65B 41/13

[52] U.S. Cl. ..... 53/170; 53/551; 53/575; 53/578

[58] Field of Search ..... 53/170, 172, 575, 578, 53/176, 550, 551

[56] References Cited

U.S. PATENT DOCUMENTS 3,388,525 6/1968 Thesing et al. ..... 53/552 X
3,890,765 6/1975 Farfaglia et al. ..... 53/563
3,983,682 10/1976 Saully ..... 53/170 X
4,495,748 1/1985 Rowell ..... 53/170 X

FOREIGN PATENT DOCUMENTS 895819 1/1982 U.S.S.R. ..... 53/575

*Primary Examiner*—John Sipos
*Assistant Examiner*—Steven P. Weihrouch
*Attorney, Agent, or Firm*—Paul & Paul

[57] ABSTRACT

A packaging machine is disclosed for making and filling packages (1) consisting of inner (13) and outer (2) containers formed from sheet material. The apparatus comprises two supply locations (35) for supplying two separate webs of packaging material (31, 32). In station A tubular outer containers (2) are constructed from the web (31). In station B web (32) is formed into individual containers sealed and filled with a flowable, e.g. liquid, material. In station C the filled inner containers (13) are mated with the outer covers (2) which are sealed in station D and discharged from the apparatus.

24 Claims, 21 Drawing Figures

Figure 1:
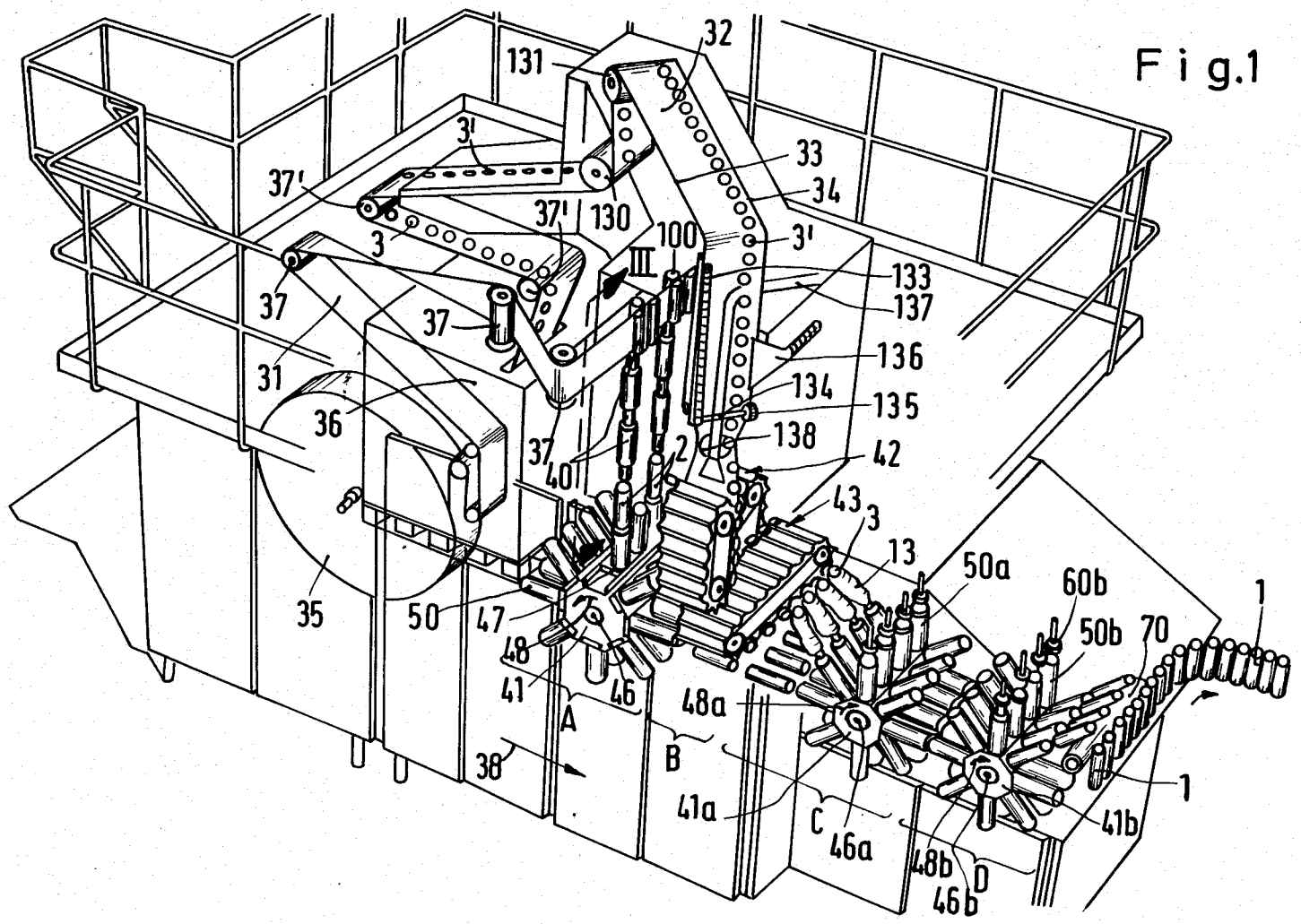

3'
163
2
162
60b
13
50b
49b
41b
4'
3'
175
174
3
13
171
172
173
3
2
4'
162
0
165
3
6
13
50a
49a
41a
13
2
3
163
161

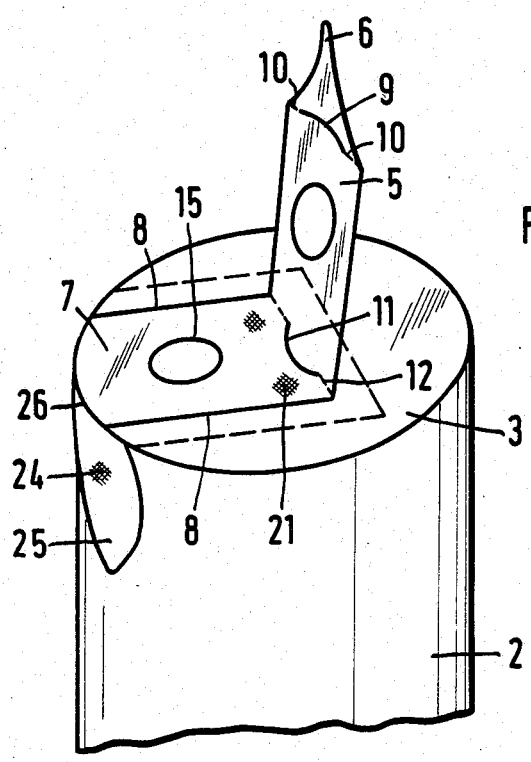
Fig.15
Fig.16
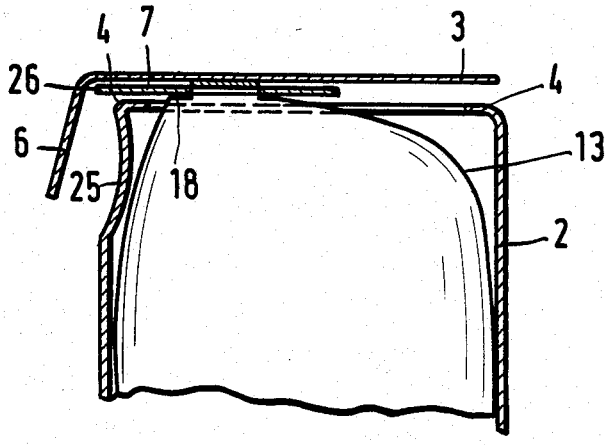

MACHINE FOR MAKING PACKS FOR FLOWING MATERIAL

The invention relates to a machine for making packs for flowing material, with a filling bag inside and a supporting cover outside.

Machines are already known for making packs to receive liquids as the flowing material. These machines operate continuously from a web of plastic coated paper; a tube is shaped, filled with liquid and severed into individual packs and welded.

Packs with a filling bag inside and a supporting cover outside have hitherto been considerably more difficult to produce. The folded box was first shaped, usually from a blank, in a machine with a similar outlay to the liquid packing machine of the above type, with filling and severing from a tube (even without any filling operation). A filling bag was made in a different machine with a comparable outlay and was placed in the open topped folded carton in a third part of the machine. It was only then that the carton could be sealed and conveyed away.

The invention on the other hand aims to provide a machine for making packs of the above type for flowing material. It must simplify production, allow for a large throughput of material and ensure reliable sealing of the fluid pack, and it must be possible to open the pack better than conventional packs with an internal bag.

According to the invention this is achieved, in that two separate supply reels are provided for drawing off two webs of material to processing stations arranged one behind the other; that shaping means to make a piece of tubing for the supporting cover from the first web of material, and a first conveying means to receive the pieces of tubing are provided at a first processing station; that means for making a series of individual adjacent, filled bags from the second web of material are provided at a second processing station; that conveying means and means for joining the bag to the piece of tubing, including a mandrel wheel, are provided at a third processing station; and that means for sealing the supporting cover and discharge conveyors are provided at a fourth processing station.

In the production machine of the invention there are thus separate and adjacent supplies for a first web of material, preferably a reel, and for a second web of material, preferably a stack folded in a zigzag shape, from which only tubular supporting covers are formed. Specially constructed filling bags are inserted in these covers at the third processing station and are fixed and sealed to them, thereby finally forming the supporting cover closed on all sides, partly at the third processing station and partly at the fourth. In contrast with prior art where an almost finished folded box—even if it is still open at one side only—is formed from a pile of blanks, the invention thus merely forms a piece of tubing as a cover component open at both ends, appropriately continuously from the first web of material. Such tubes can advantageously be picked up, transported and appropriately processed by a conveyor belt and/or mandrel wheels. If, in accordance with the above further feature of the invention, a series of adjacent filled bags is produced equally continuously from a second web of material, additional mandrel wheels can join the bags to the tubes in a simpler manner because the tubes are still open at both ends. Finally suitable measures have to be provided to enable the open-ended tubes to be sealed, and this is done by sealing means cooperating with the mandrel wheels.

Thus it will be appreciated that webs of material to be processed continuously are prepared, brought together and joined in such a way that packs of flowing material of the type in question can be made by an efficient machine with a high throughput and that the packs are also easy to open, as will be explained below.

According to the invention it is desirable that the first web of material is mounted on a reel as the storage location and comprises a web of paper coated with plastics on at least one side, and that the second web of material is stored in the form of a zigzag stack as the supply location and comprises a web of plastics sheeting laid double, with cover portions sealed onto at least one end and possibly two diametrically opposed ends. Thus instead of the known paper blanks, the first web of material used in the invention for continuously drawing off and processing is a packaging material which has in the past been employed in pack making machines of the above type which make a tube, fill it with liquid and produce individual packs by transverse welding and severing. If the teaching of the invention is followed a very thin plastic coating on the web of paper is sufficient, for the fluid to be packed is in the bag, which is supported by the paper pack.

Known webs of plastic tubing lie in the external folded box without any particular attachment. In the invention, on the other hand, cover portions are sealed onto at least one and preferably two ends of the filled, detached bag and are used to close the supporting and covering tube. It will be seen from this that the finished bags are fixed in the finished cover closed at both sides. This surprisingly opens up the possibility of favourable mass production and an improved opening arrangement. The above measures enable one to seal an opening tab onto the sealed-on cover portion or onto one of the two opposing cover portions, in such a way that when the tab on the cover is pulled upwards a hole is simultaneously torn in the insert bag, so that the pouring out process can start as soon as an opening strip has been pulled off. The use of a web of sheeting laid double with the cover portions sealed onto it further advantageously enables the bag to be completely filled with flowing material, particularly liquid, without any fear of the liquid spilling during the opening process. In a preferred embodiment the cover portions at the opposing ends are sealed onto the web of sheeting over quite a large area, which forms an annular seal around the sealing region which is torn open when the opening strip is pulled upwards. In this way the bag remains hanging from the cover portion even when it has been torn open, and consequently spilling is avoided in the opening process and air can get between the cover and the bag while liquid is being poured out through the said hole in the lid. It will be appreciated not only that this is a favorable opening method but also that pouring out is a simplified and advantageous process with such a pack.

It can be manufactured particularly advantageously if, according to the invention, the shaping means at the first processing station include shaping flaps engaging round a mandrel, with a sealing station and two edge flanging stations, and if the mandrels on the wheels are external ones. The fact that the mandrels are external ones surprisingly simplies the means which are used to insert the finished filled bag in supporting tube components located in the mandrel. It also enables the free edges of the tubes to be flanged, so that the said cover portions seated on the sheeting portions can be welded on with simple means.

At the first processing station the piece of tubing is made from the first flat web of material, the coated paper web, by dividing it into cladding pieces, guiding them into a tubular shape with the shaping flaps and welding them with a lengthwise seam in that shape, to produce the desired covering tube.

According to the invention it is particularly desirable that, as seen in the direction in which the first web is conveyed, cutters for detaching flat pieces of web should be arranged adjacent a first position 1 of the shaping flaps, the flaps being mounted on a slide and movable to at least a second position and back, sealing stations preferably operating with hot air should be arranged at the second position downstream thereof, and a movable flanging tool should be arranged in a further position downstream thereof, and that the mandrel should be mounted stationary, extending at least from the sealing station to the flanging tool.

It is preferable to operate simultaneously in each position with two adjacent shaping flaps, which are two members rotatable about a common shaft like a hinge, and which, when brought together, engage right round the mandrel and the severed piece of the first web wrapped round it. The hinge or the shaft connecting the two flaps at each station is desirable fixed to a slide in each case, and the two slides can be moved together into the first or second position and back. The first position is preferably vertically above the second. In the first position the flat, severed piece of web is brought into the desired tubular shape around the mandrel. The pieces of web in this shape are moved down into the second position, and here the longitudinal edge of the tubes can be prepared with hot air and have the finished lengthwise seam formed in it by a pressure piston. Appropriate conveying tools such as clips, slides or driving jaws draw the finished tube vertically down into a further position, where the flanging tool flanges one end of the tube, in this case preferably the lower end. This produces an annular rim onto which a cover portion of appropriate construction can be sealed.

In a desirable further embodiment of the invention a recess cooperating with a projection from a piston is provided at a point on the periphery of the rear end of the mandrel, to form a pouring edge on the pack. The rear end of the mandrel is the end seen in the direction of flow of the web of material, the lower end in the present embodiment with the vertical arrangement. The above-mentioned flanging tool will preferably also be arranged at this point, so that the recess in the edge of the cylindrical side wall of the tube can be formed simultaneously with flanging. The recess is preferably made at the location of the tear-off strip of the opening device in the lid (top end portion). A liquid pack of this type is preferably torn open from the outside towards the centre. In the region below the upwardly torn cover strip, which is made of the actual lid material (by incisions), there is an inner cover strip with a hole to form the pouring out aperture, and the bag is sealed down in a circle around the aperture in the manner described above. If liquid is then poured out, the jet at the pouring edge will readily come away from the side wall below that edge, since the said recess prevents any liquid from clinging to the outer wall, possibly as a result of adhesive forces, and flowing down it.

A first embodiment of the invention is characterised in that the first conveyor receiving the tubes is a first mandrel wheel. A different embodiment with an endless belt as the conveyor will be described later.

A favourable feature of the invention is that the first mandrel wheel has two external mandrels, and preferably four external mandrels axially displaceable on a mandrel slide, on each working surface in the direction of its shaft. In this way the pair of shaping flaps can wrap the pieces of covering tube round two mandrels at the first movement and—after axial displacement of the slide—round the two other free mandrels at the second advancing step, so that from this first mandrel wheel onwards there are always four items being processed. The throughput of the machine can be greatly improved in this way.

The first processing station has so far been described, with its appropriate shaping means and the first mandrel wheel. In this station four tubes have been formed from the first web of material (paper), flanged at one end and picked up in a first mandrel wheel.

At the above-mentioned second processing station the individual filled bags are made from the second web of material. They then have to be combined with the tubes at a third processing station and partly undergo further processing. The equipment at the second station, with which filled bags with the cover portions sealed onto them are made from the web of sheeting, will not therefore be described in detail.

The equipment for making the bags at the second processing station includes at least two direction changing rollers set at an angle of approximately 30° to 60°, preferably 45° to one another,
also a longitudinal sealing station,
a filling pipe,
shaping and welding chains below it,
a transversely distributing conveyor,
detaching means and
discharge means.

The second web of material provided to make the bags is taken not from the reel but from a supply in the form of a stack laid in a zigzag shape. The reason for this is the sealed on cover portions. At the places where they are welded to the sheeting there is a considerably thicker area of material than adjacent them where there are only two superimposed sheets. Winding onto a reel would be made difficult by this fact or would cause damage to both webs of material. It is particularly desirable to use a web of material (to before the longitudinal welding and filling station) with the two edges of the sheeting not yet joined at the side opposite the folded seam and with the cover portions each arranged at the edge on the external surface of opposing halves of the web in the flat areas thereof. In this way the second web in that form can be transported over direction changing rollers and also set at angles as if the cover portions were not adhering to the sheeting.

The purpose of diverting the second web through the direction changing rollers set at the above-mentioned angle to one another is to enable the two cover portions to be correctly positioned in the next piece of apparatus for combining the bag and tube. It has already been mentioned that in the lay-flat state of the web the cover portions are still arranged on the flat surfaces and at the opposing edges of the halves of the web. The direction changing rollers are responsible for feeding the second web of material, the web of sheeting, to the tubes at an angle relative to the longitudinal and processing direction of the entire machine, such that the particular bag is turned relative to the flat position of the web shape, so that a line joining one cover portion to another runs in the longitudinal direction of the machine and the processing direction.

This turning of the web can be explained graphically, for example if one severs a piece of web, e.g. with only two or three successive cover portions on it and thinks of it as being already sealed longitudinally at the side opposite the fold. If both hands are then placed flat inside the sheeting so that their outer edges come up against the folded and welded seams, then one can easily imagine a rotation of both hands in the same direction through the same angle of e.g. 40°. This causes the folded seam and opposing sealed seam automatically to move a certain distance laterally away from the ends, while the cover portions, previously on the flat part, are brought to the ends by the rotation. The technical means in the machine for carrying out the equivalent rotation will now be explained in detail.

Another advantageous feature of the invention is that the spindles of both direction changing rollers are each in a horizontal plane, and that the filling pipe and the opposing shaping and welding chains, which interact in pairs to form a series of tube-shaped cavities, extend in a substantially vertical direction over the horizontal planes of the shafts of the mandrel wheels. This construction enables the web, with the cover portions still flat and parallel, to be diverted from a supply in the lower part of the machine to an upper part. Here the feed member of the vertically arranged filling pipe is inserted through the open side of the plastic tube and from there guided vertically round the filling pipe, and down past it into a means for welding and detaching the bags, in the form of the two above-mentioned shaping and welding chains. The shaft of the already mentioned first mandrel wheel lies parallel and transversely to the longitudinal direction of the finished bag (sic); and also transversely to the rotary shafts around which the shaping and welding chains are guided. Since the general conveying and processing direction of the machine, i.e. the longitudinal direction, runs transversely to the axial direction of the mandrel wheels, the line joining two cover portions in each bag just produced must also run in the longitudinal direction of the machine, because the mandrels are also in the longitudinal direction in certain positions. In this way, position by position, further processing, i.e. flanging, transporting, combining tube with bag, welding together at one end, sealing at the other end etc., takes place on the mandrel wheel or through transfer from one wheel, longitudinally of the machine to the next.

It will also be noted that the first processing station with the shaping means to make the tubes and with the first mandrel wheel, is arranged at a spacing from the second processing station and at a still larger spacing from the downstream mandrel wheels, in the longitudinal direction of the machine.

The moulding and welding chains form a series of tubular cavities in the web, from which the bags are finally made. Without the webs of sheeting the chains, interacting in pairs, form vertically superimposed tubular cavities between them; these can be thought of cylindrical cavities if two half cylinder, one on each chain, are held together. Instead of links the chains each have an endless row of successive half shells or troughs. One group of these is heated and the opposing group is in the form of backing jaws, and in this way the individual bags are formed by pressure and welding through the filled plastic tubing.

The cover portions are outside the half shells or troughs of the chains to the front and rear and lie in planes substantially normal to the shafts of the rollers driving the chains. Instead of the filling pipe, the web guided along it and the main direction of the relevant surface of the chains being vertical as described above, guidance at a certain inclination could of course be provided. However, guidance in a direction with a vertical component is always desirable, because the level of the flowing material should be above the shaping and welding chains and below the longitudinal sealing station.

The invention is desirably further constructed so that a control ring supporting the web is fixed below the longitudinal sealing station with its slot-shaped hot air nozzle, over the two shaping and welding chains, within the second web of material and engaging round the filling pipe at a spacing. The turning of the web through the said angle, so that the two cover portions initially lying flat on the web are turned out of the edge regions and into the ends takes place more easily if the web is spread out in three dimensions behind or under the longitudinal sealing station and pulled over the supporting or control ring, since this removes any preorientations of the web resulting from folded edges, longitudinal seams or the like.

A further advantageous feature of the invention is that the transversely distributing conveyor has an endless trough chain guided substantially horizontally around two horizontal, spaced shafts, with cutting means between the troughs to detach the bags. The cutting means between the troughs are preferably slots to receive a cutting blade. It is then sufficient to have a cutting or shearing means arranged at a point below the shaping and welding chains, so that the blade enters the recess between two troughs and severs the piece of sheeting forming a bridge between two successive filled bags. The cutting line desirably passes through the centre of a broad seam, namely the sealed or welded seam formed by the shaping and welding chains. The trough chain has the advantage of protecting the chain or bags which during the operation emerge continuously from the pair of shaping and welding chains, as the bags can then be detached in an equally protective way. If the transversely distributing conveyor is arranged in the position described above, then the bags will clearly be in a direction lengthwise of the longitudinal and processing direction of the machine, i.e. in a favourable position to insert the filled bags in the hollow tubes.

Transfer from the trough chain to the tubes is particularly successful when discharge conveyors with clamping means are provided, acting transversely to the conveying direction of the trough chain. Gentle and rapid removal can be obtained with pressure pistons, pulling means or conveyors, with the clamping means ensuring that the bags, which were deposited in a certain way in the trough of the chain, do not become twisted. This applies particularly if one of the cover portions, e.g. the lid provided with the opening device, has a ring pull or the like projecting outwardly over the periphery and if it has to be kept in a certain position in the machine for further processing.

The last described features in respect of the second processing station have so far covered the measures whereby the special web of sheeting is changed in its direction in the manner described, so that the cover portions come to rest at the ends of the finished filled bag, and whereby prior to the filling process the web is tightly sealed lengthwise at its free end, then is filled, transversely welded and detached, and lies in the troughs of the trough chain ready to be ejected with correct positioning for further processing. These are the measures at the second processing station, the formation of the tubes having been explained previously in connection with the first station. The joining of the bag to the tube now follows, in a further explanation of the third processing station. As already described above, this station has conveying equipment and means for inserting the bags in the tubes.

The invention has the desirable feature that the conveying equipment at the third processing station comprises at least two and preferably four adjacent guide channels, arranged transversely to the conveying direction of the trough chain and inclined to the horizontal, and that the spacing between the channels is smaller at the inlet than the outlet side. It has already been explained above that the web of sheeting is first guided into the upper part of the machine and from there brought down again parallel with the filling pipe. The substantially vertically operating shaping and welding chains are arranged above the substantially horizontally operating trough chain, and it is not difficult in the invention to arrange the whole construction for forming the bags high above a generally low processing plane, in which the shafts of the mandrel wheels are preferably located. In this way, apart from the equipment for taking the filled bags out of the trough chain and into the hollow tubes, gravity and the weight of the bags filled with material can be used to join the bags to the tubes. Gravity and the weight of the filling material is best exploited with the above mentioned, inclined guide channels, in which the filled bags from the trough chain can slide with a pushing or pulling action directly into the prepared hollow tube. Additional auxiliary supporting plates or similar tracks can possibly be arranged at the transitional points. However, the important point about the measures just described is that the distance between the guide channels at one end is smaller than that at the other end. The reader understands that the troughs in the chain are relatively close together, for their position has to correspond exactly to the half shells of the shaping and welding chains and thus to the product emerging from them, the chain of bags. However, the bags are only separated from one another by a transverse seam (as seen in respect of the tubing). For operation with and for the construction of a mandrel wheel, somewhat more space is required at the other end, between the individual mandrels of a wheel, which in the preferred embodiment has four mandrels in the direction of its shaft in each angular position. In order to enlarge the spacing between the four mandrels there must be adaptation by means of the guide channel. Since the lateral component in the spreading of the guide channel from the end with the small spacings to the lower end with the larger spacings is small, it does not impede the bags when they slide through or when the weight of the filling material is utilised in transferring the bags from the trough chain to the tube.

A desirable feature of the invention is that the mandrel wheel with the means for joining the bag and tube is in the form of a second wheel with external mandrels, and has two and preferably four external mandrels on each of the e.g. eight working surfaces in the direction of its shaft, and also pneumatic means to generate low pressure and/or high pressure in at least some of the mandrels. The number of mandrels in the direction of the shaft of the wheel has already been discussed. If this and possibly other wheels have pneumatic means of the type just described, the conveying of a bag into or out of the hollow tube—or the conveying of bags with tubes out of the mandrel—is facilitated by providing internal suction instead of or in addition to the pushing in process, and by performing the pushing out or withdrawing action either with external grab means or by internal pressure—or possibly both.

The tube and bag are combined inter alia with the aid of pneumatic means, i.e. by sucking partly inserted bags into the hollow tube inside the mandrel on the wheel. This pushing in and simultaneous suction is not disturbed by the fact that the cover portions are stuck to the ends. Moreover it has been found in practice that, with the softness of the tube material, not even the flanged edge is a hindrance or even damages the thin plastic material of the bag.

In a further advantageous embodiment a means for welding on a first cover portion to seal one end of the tube is provided at one mandrel position on the second wheel. With this arrangement the pneumatic means on the second wheel, together with the weight of the material, have an advantageous effect, in that the bag inserted in the tube from above tends to sink further down provided that at least a vertical component is maintained. If the said mandrel position of the second wheel is assumed, with the second welding means in the centre, vertically above the shaft of the second wheel, this vertically acting force has a particularly marked effect in the bag. The sheeting material is thereby drawn out of the region between the depositing edge at the end of the tube and the peripheral edge of the cover portion to be joined to it, thus ensuring that the first cover portion, e.g. the lid, is securely welded to the tube.

The welding on process is particularly successful when, in accordance with the invention, the welding on means comprises a pressure piston, arranged to move vertically over the central upper position of the mandrel, and adjacent the piston hot pressure jaws or hot air nozzles engaging round the outer free end of the mandrel and movable substantially transversely to the direction of movement of the piston. Here the radiation of heat makes the plastic material soft and sticky, thereby preventing any lengthy application of heating jaws from opposite sides of the web of paper, with a corresponding flow of heat through the paper. The cover portion and tube are thus quickly and reliably joined.

The measures just described at the third processing station, with equipment for joining the bag and tube for the first time, are finally followed by further measures at the fourth station, where sealing means for the entire supporting cover and removal means are provided. The supporting cover altogether comprises the piece of tubing with the two end portions placed on it. At the third processing station just described the tube and bag have been combined and a cover portion of the bag, preferably the portion with the opening device which will later be the lid, has been welded to one end of the tube. The fourth processing station is now responsible for welding the opposing cover portion onto the other, still free end of the tube and removing the thus completely closed tube, i.e. the entire supporting cover or finished pack.

Another favourable embodiment of the invention is characterised in that a third mandrel wheel, a means for transferring tubes from the second to the third mandrel wheel and a means for welding on a second end portion to seal the tube completely are provided at the fourth processing station, the third mandrel wheel being arranged adjacent the second mandrel wheel and having the same number of mandrels, a parallel wheel shaft and the same rotary direction. It is particularly advantageous if, in accordance with the invention, the third mandrel has pneumatic means to generate low and/or high pressure in at least some of the mandrels, and if a discharge conveyor is arranged at the side of the third mandrel wheel opposite the second wheel. The removal conveyor is at the discharge end of the machine, virtually at the extreme rear position longitudinally of it. It picks up the finished fluid pack and feeds it to further testing and packing stations.

At the fourth processing station, which has been described it terms of the above measures, the bilateral sealing and completion of the fluid pack is done by means of mandrel wheels. Whereas the second mandrel wheel described above still belonged to the third processing station, suitable transfer means are responsible for pushing four unilaterally closed tubes with bags inside them from the second mandrel wheel to the third with appropriate timing, so that an open end of the tube, which still has to be processed, is brought to the outside. Appropriate rotation of the third wheel can turn these still unfinished ends to a position in the machine which is readily accessible to welding means similar to those already described. Then the other cover portion, which of course is already on the bag, is welded on, providing the second and final seal on the supporting cover.

With the bag being inserted in the hollow tube at the third processing station, it may happen that the first cover portion to be inserted in the tube, e.g. the base, is left with its outer edge inside the flanged rim at the end of the tube, despite the inward suction from the pneumatic means in the second wheel. The cover portion could possibly even bend, with the flanged rim at the end of the tube still remaining outside its periphery. This state may persist even if the tube, processed and correctly closed at one side, is ejected pneumatically.

In this eventuality it may be desirable for the welding means to have a pressure piston provided with suction means on the third mandrel wheel, preferably over it in the central vertical, top position. Before the plastic surfaces on the rim and cover portion are stuck together by welding and pressure, the piston pulls out the cover portion, thereby reliably ensuring that it is laid externally on the flanged rims of the still open end of the tube and is pressed down so that the thermally softened plastic adheres.

Another preferred embodiment of the invention is characterized in that the first conveyor receiving the tubes is an endless belt moving around vertical shafts and adapted to advance by one unit and by three alternately. It has already been indicated above that the first conveyor to receive the tubes, instead of being a mandrel wheel, may in the second preferred embodiment now to be discussed be an endless belt moving around vertical shafts. The shaping of the tubes is the same as described above, only the finished tubes are fed onto an endless supporting conveyor which has a step-by-step switching system as previously described, which could be termed a 1-3 cycle. The two mandrels from which the finished tubes are withdrawn have the same spacing as holding means on the endless belt for the finished tube have, plus an intermediate supporting mandrel. In other words, two finished tubes are drawn onto the endless belt, onto holders or mandrels and a further holder or mandrel is left empty between them. If the endless belt is then advanced one unit, the stationary mandrels will again be opposite two holders or mandrels on the belt for discharge of the tubes. If these are again provided with tubes after the filling process, the belt is advanced three units, so that the stationary mandrels then again have the initial state on the endless belt opposite them for the withdrawal of the finished tubes.

Another advantageous feature of the invention is that the external mandrel of the second wheel has a thin cylindrical wall to receive the bag internally and to hold the tube externally, and that the free annular edge of the wall is provided with a thickened rim. In this way a good backing support is provided for the flanging and welding tools, so that the flanging or folding and welding processes can be carried out in a particularly reliable way. It is therefore also desirable to have means for flanging the outer annular edge of the tube and means for welding on the second cover portion provided on the second and/or third mandrel wheel.

Figure 7:
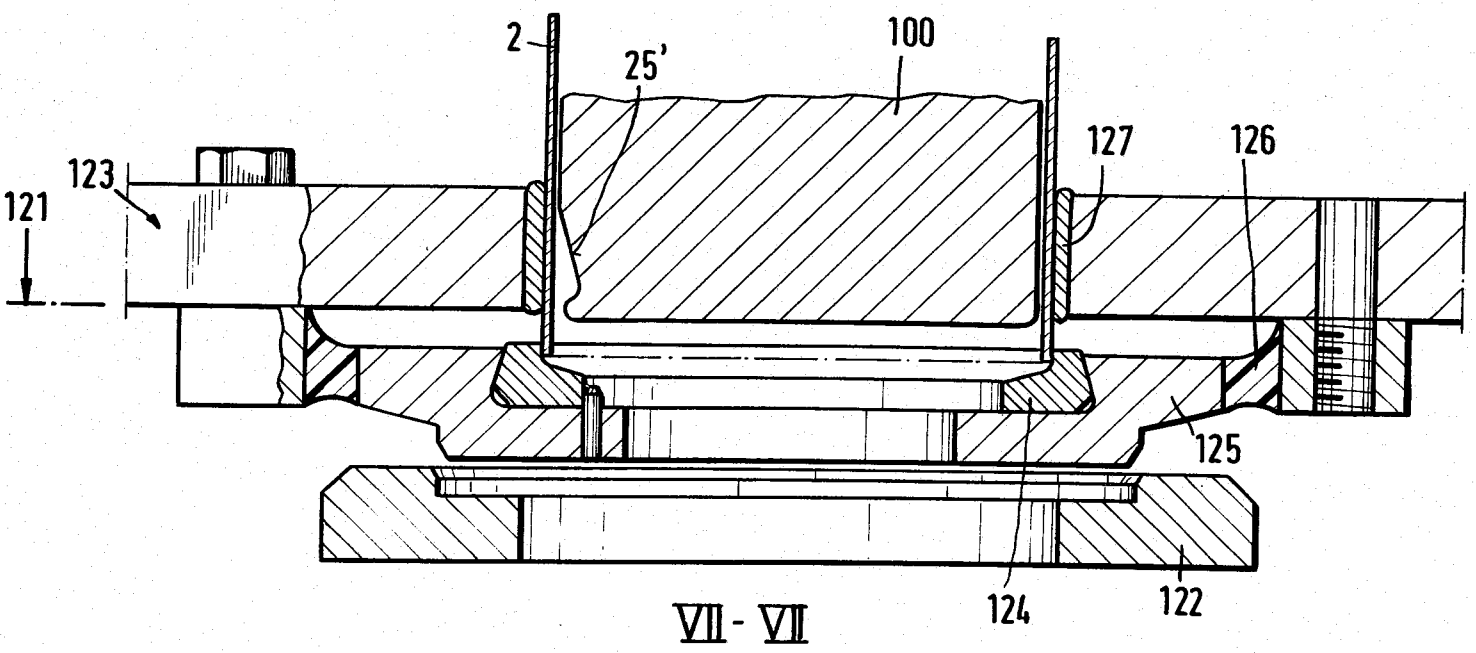
Figure 8:
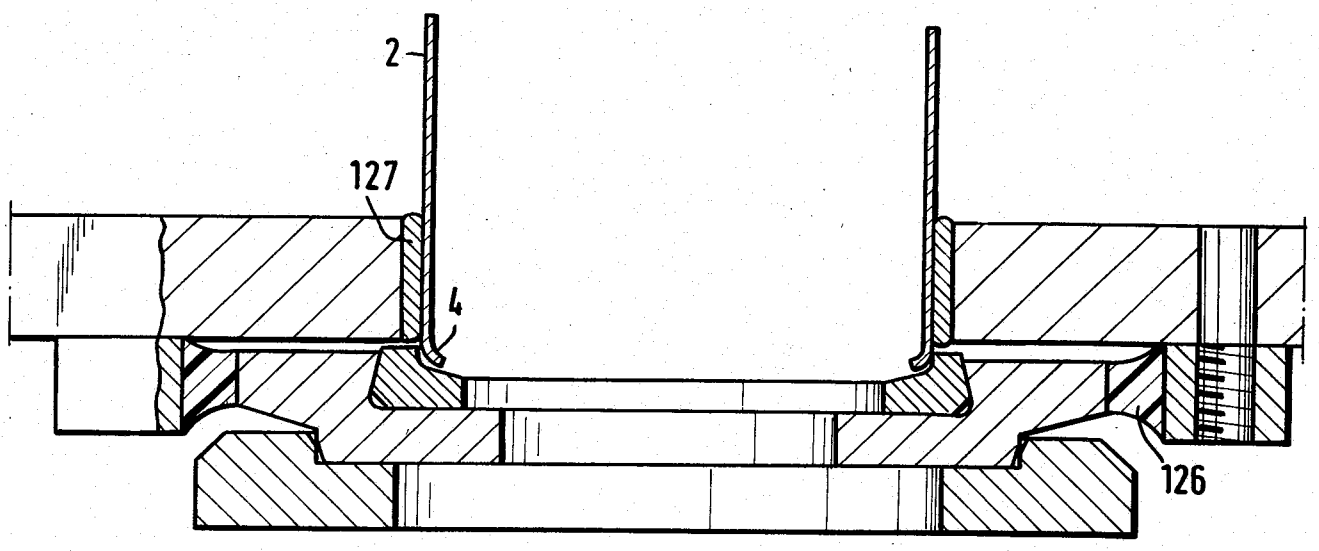
Figure 9:
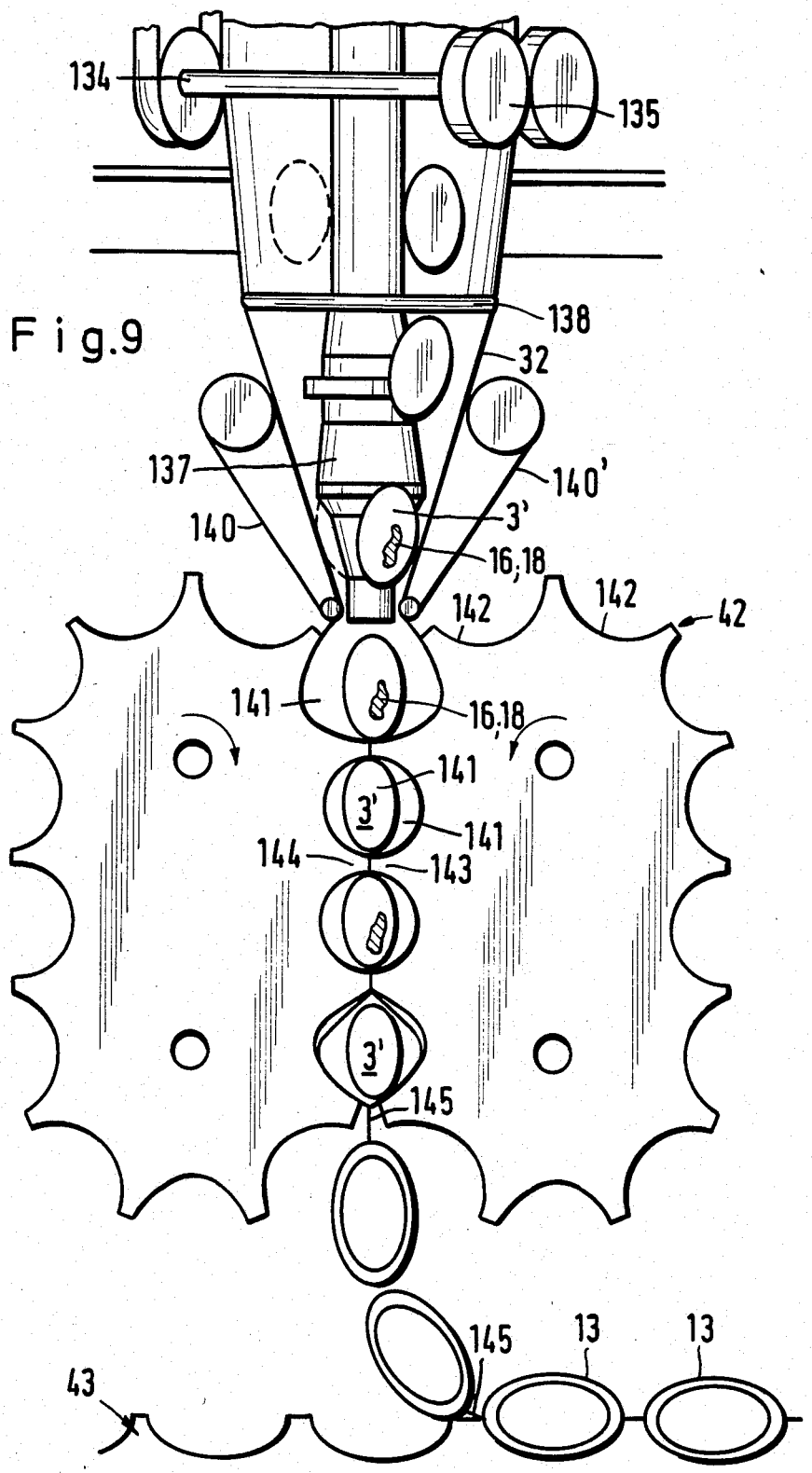
Figure 10:
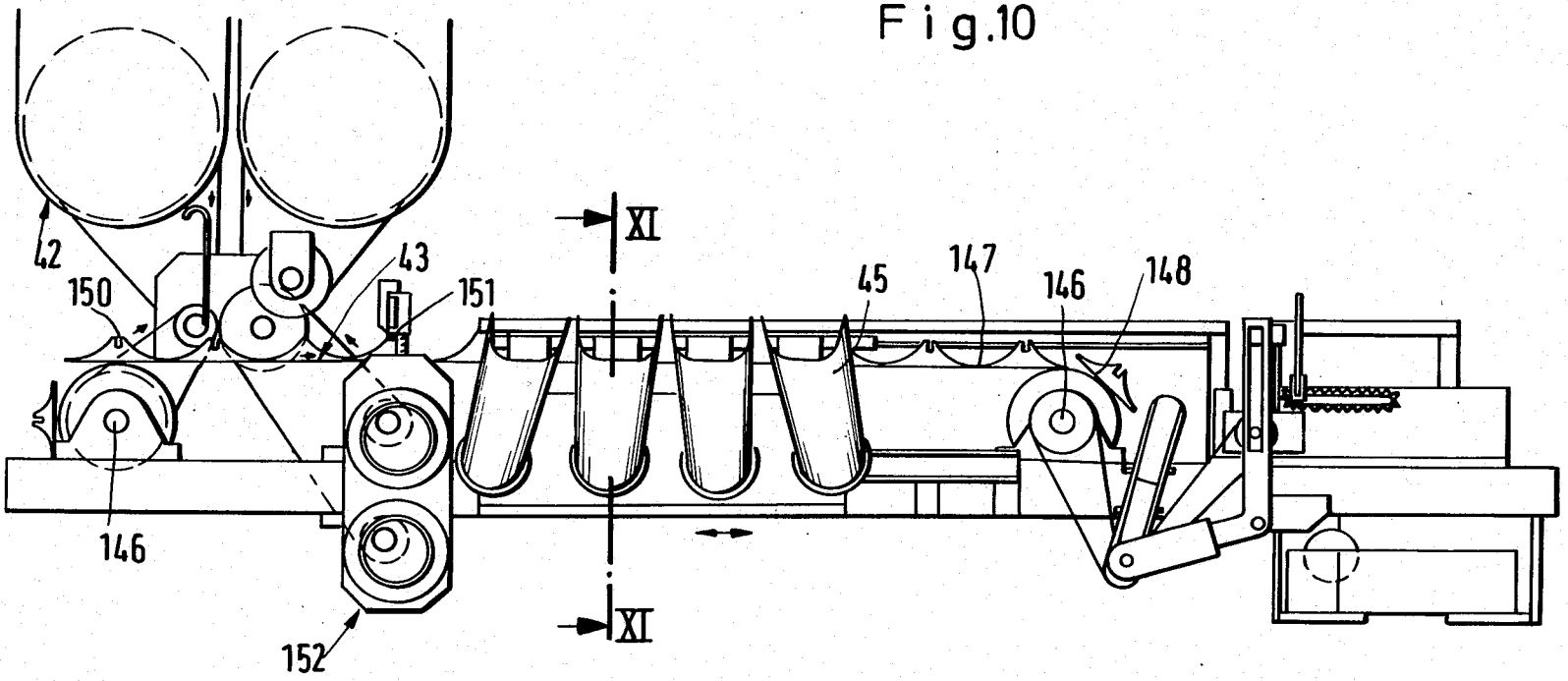
Figures 11, 13:
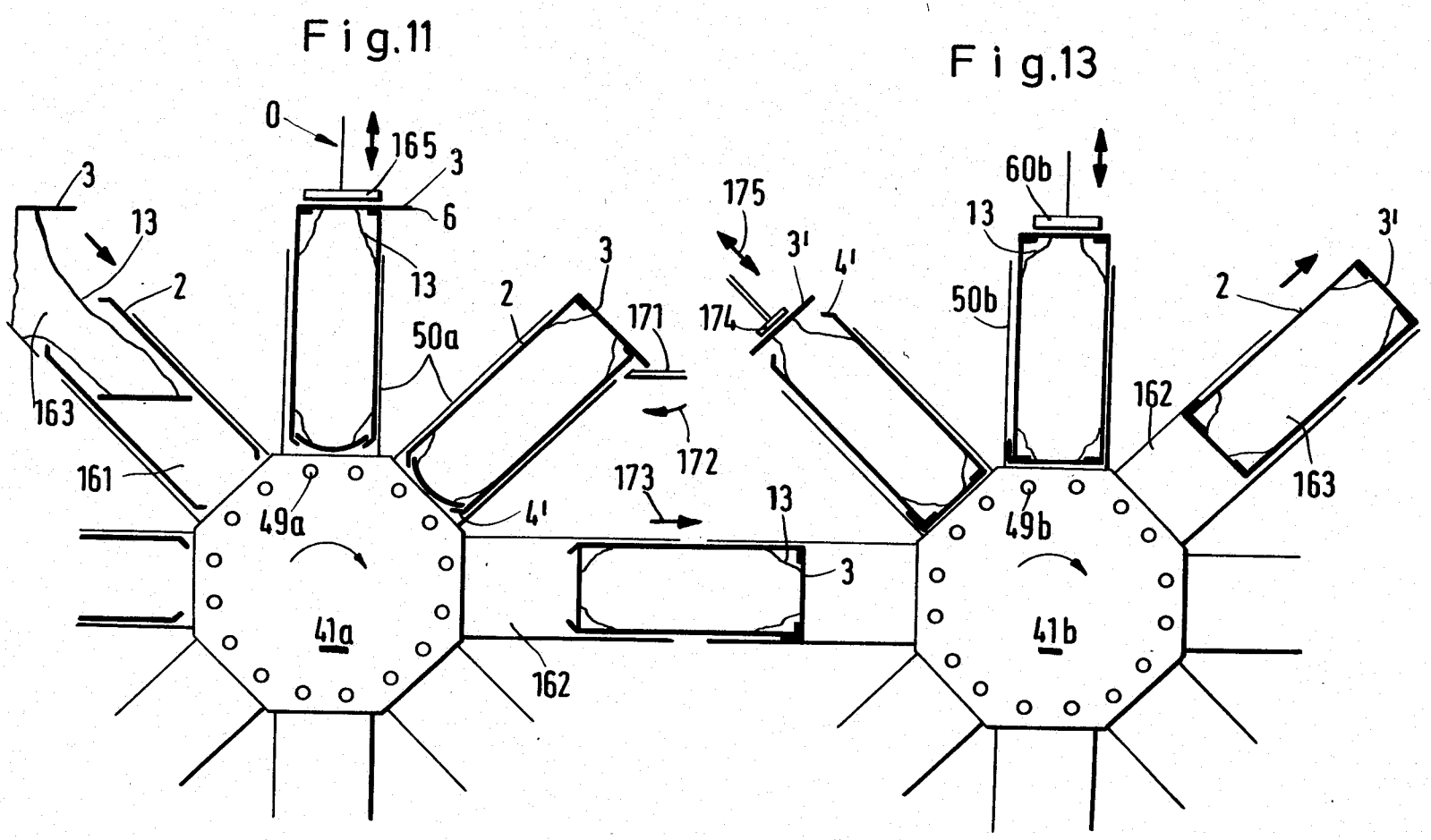
Figure 12:
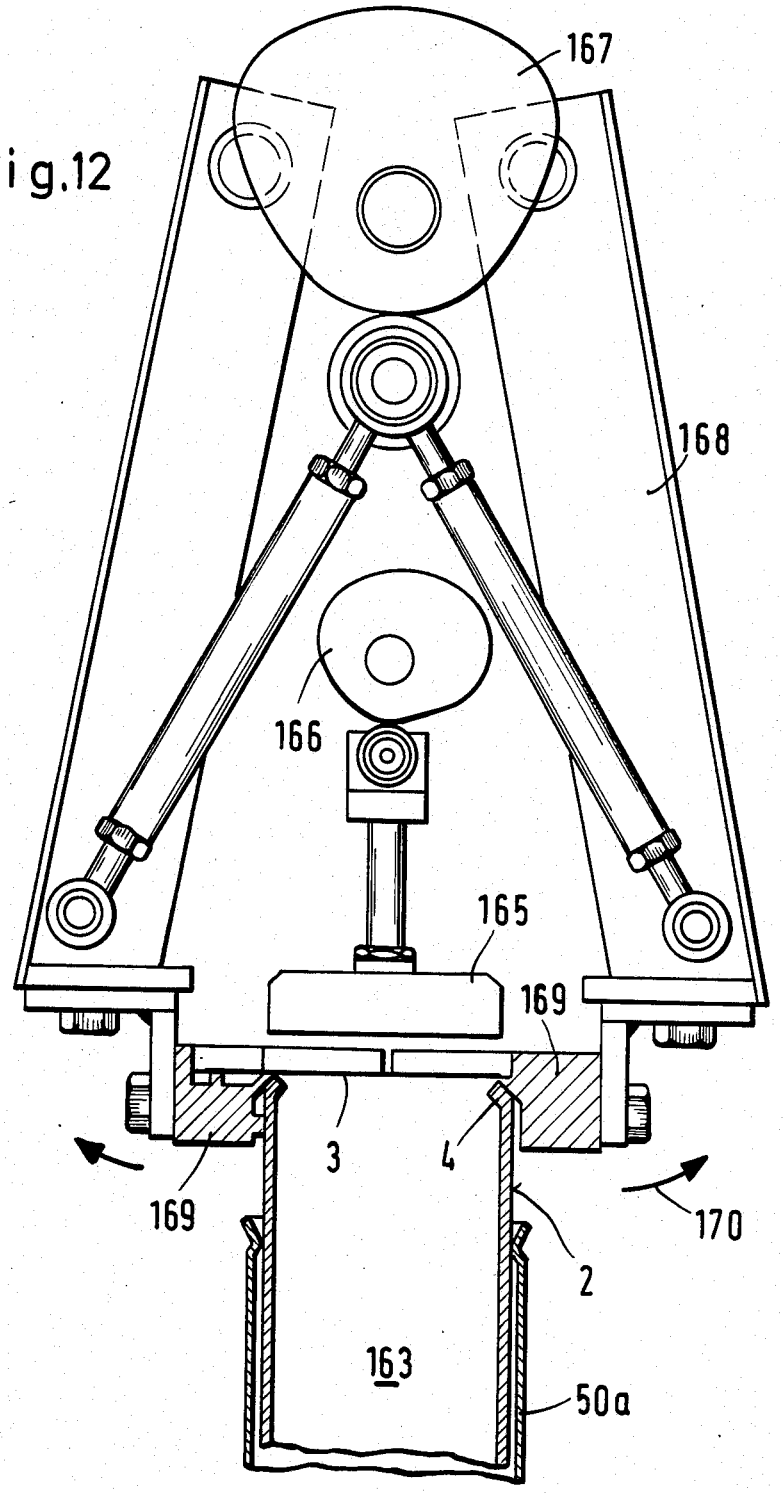

Other advantages, features and applications of the invention will emerge from the following description of a preferred example, in conjunction with the drawings. In these:

FIG. 1 is a perspective over-all view of a preferred embodiment of the machine according to the invention for making packs for flowing material, FIGS. 2 to 8 show means for making the hollow piece of tubing for the cover, FIGS. 9 and 10 show parts of the machine for making the filling bags, and FIGS. 11 to 13 show the bag and piece of tubing being put together and the pack being sealed.

Figure 2:
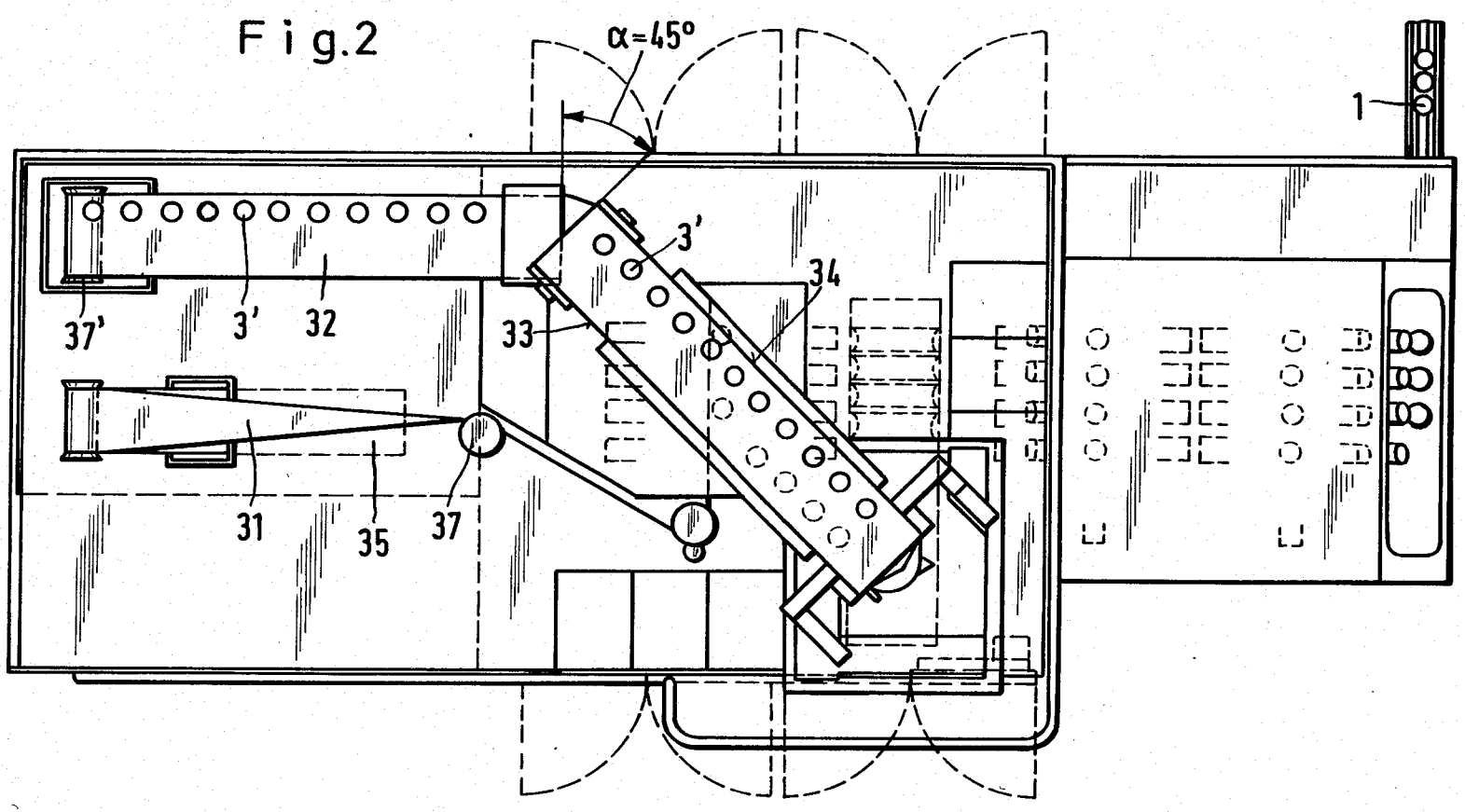
Figure 3:
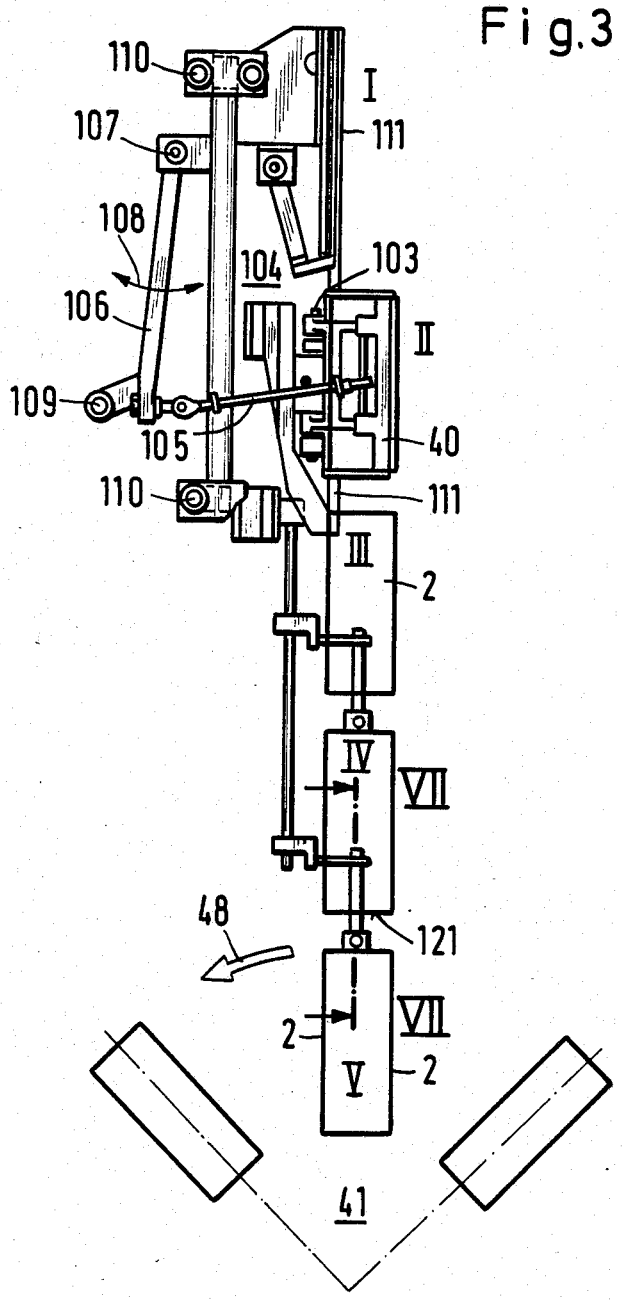
Figure 4:
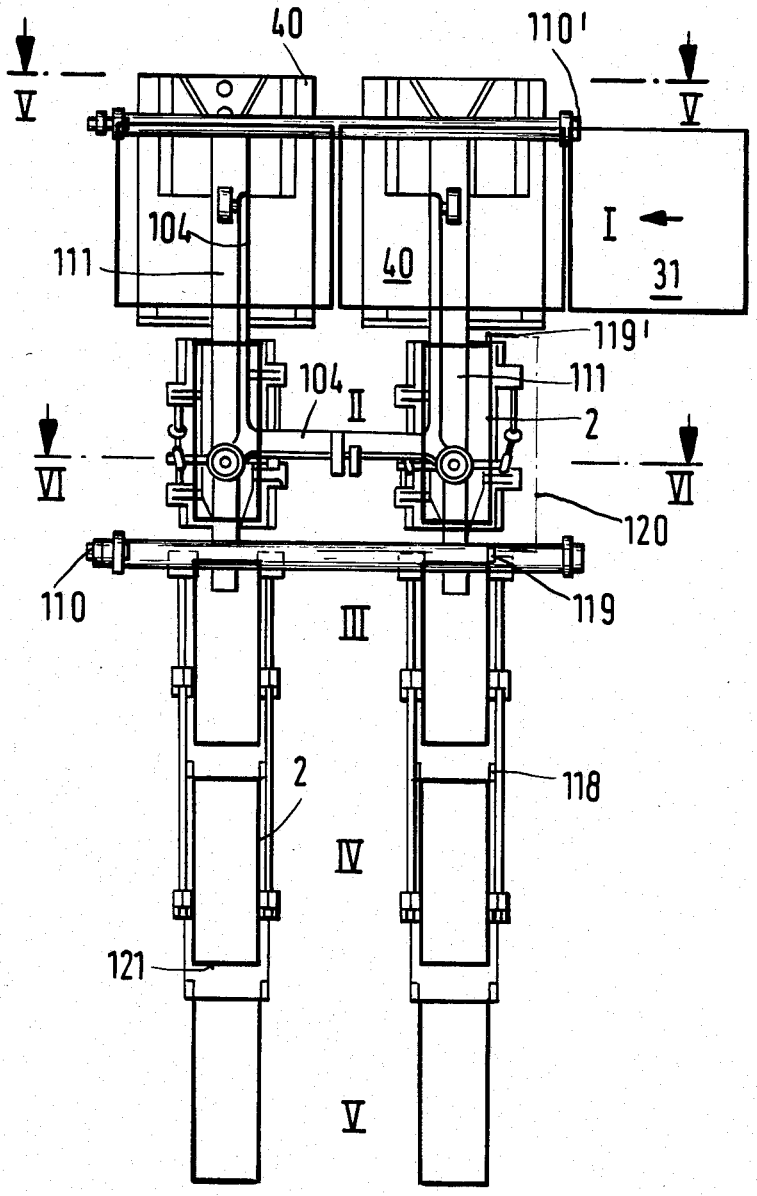
Figure 5:
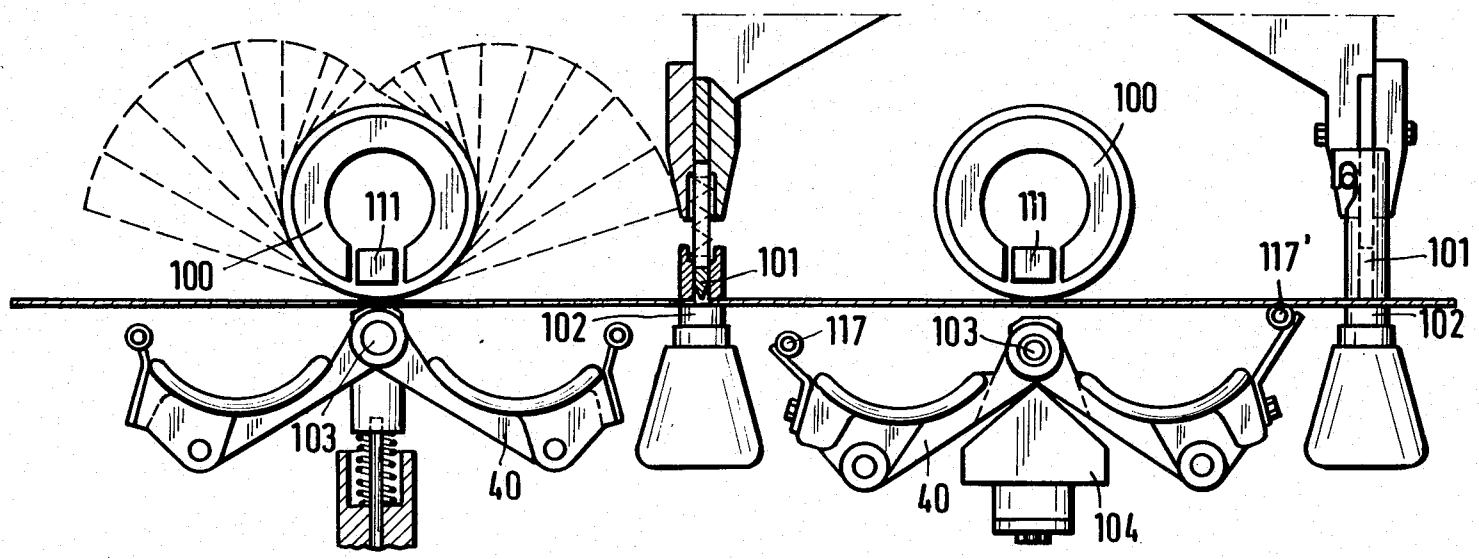
Figure 6:
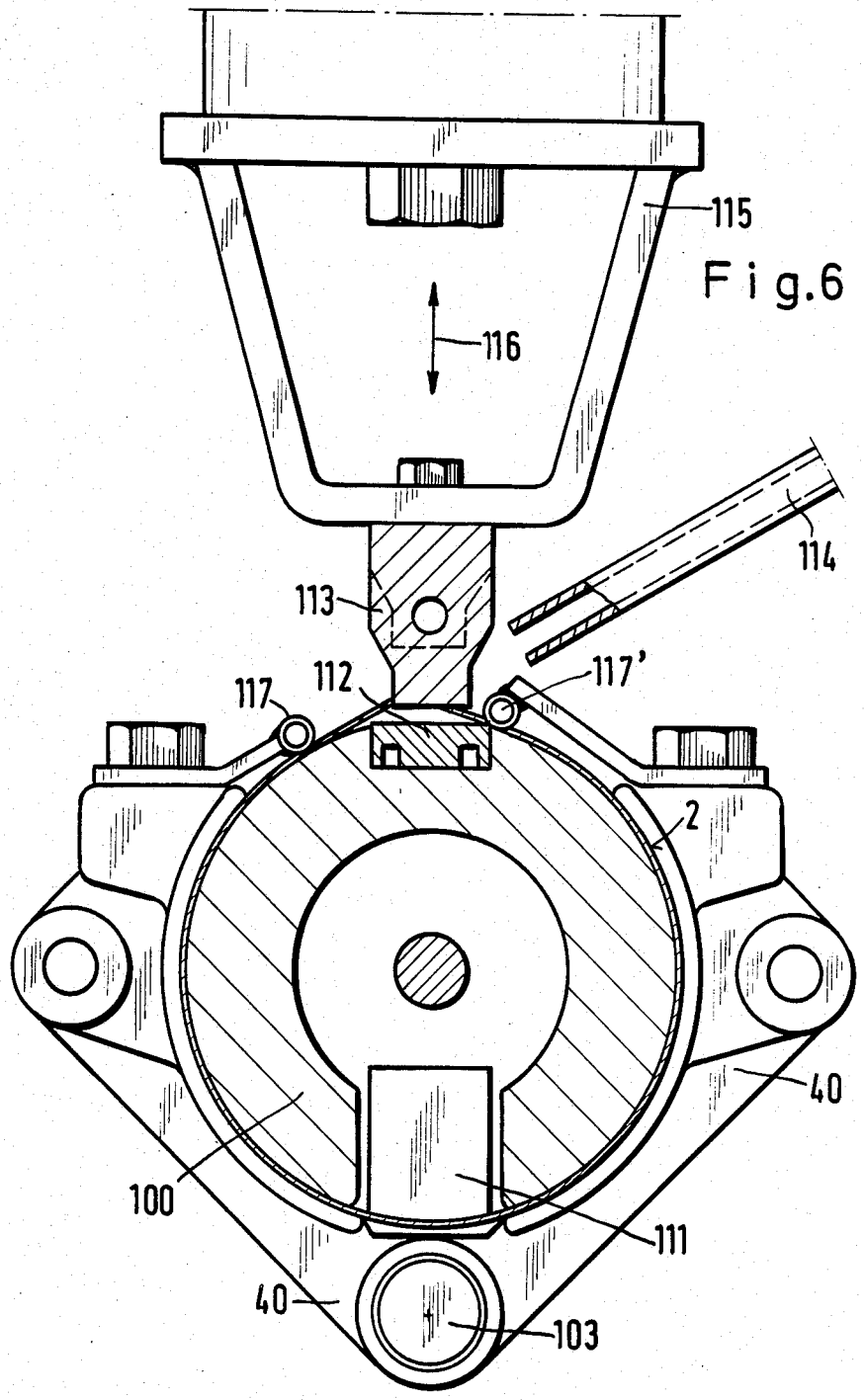
Figure 14:
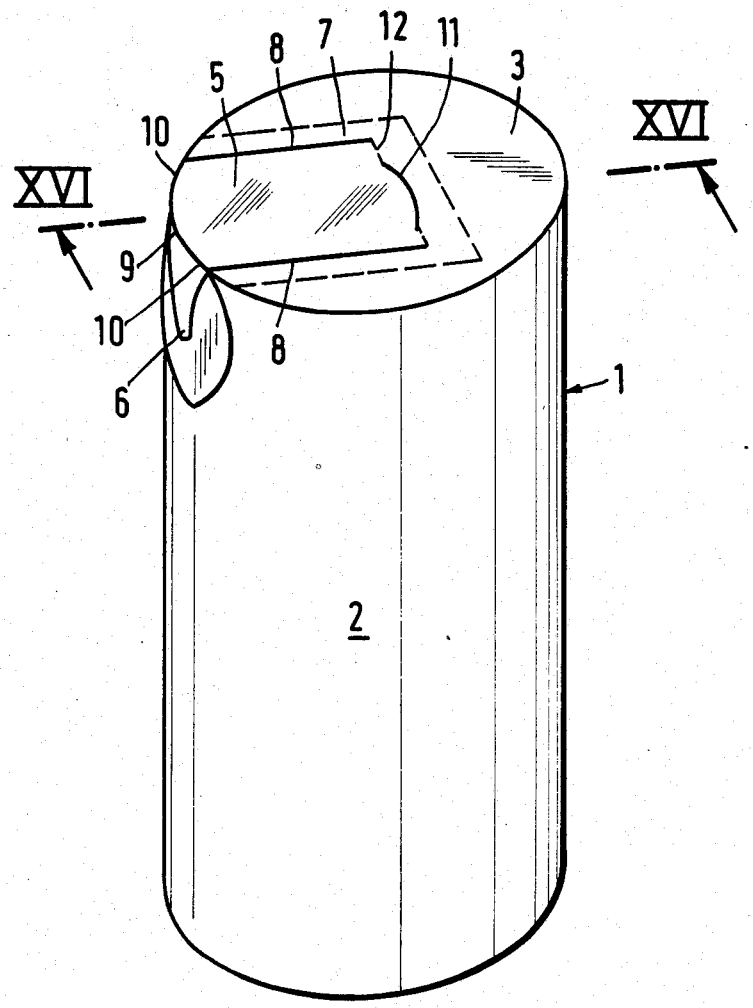
Figure 17:
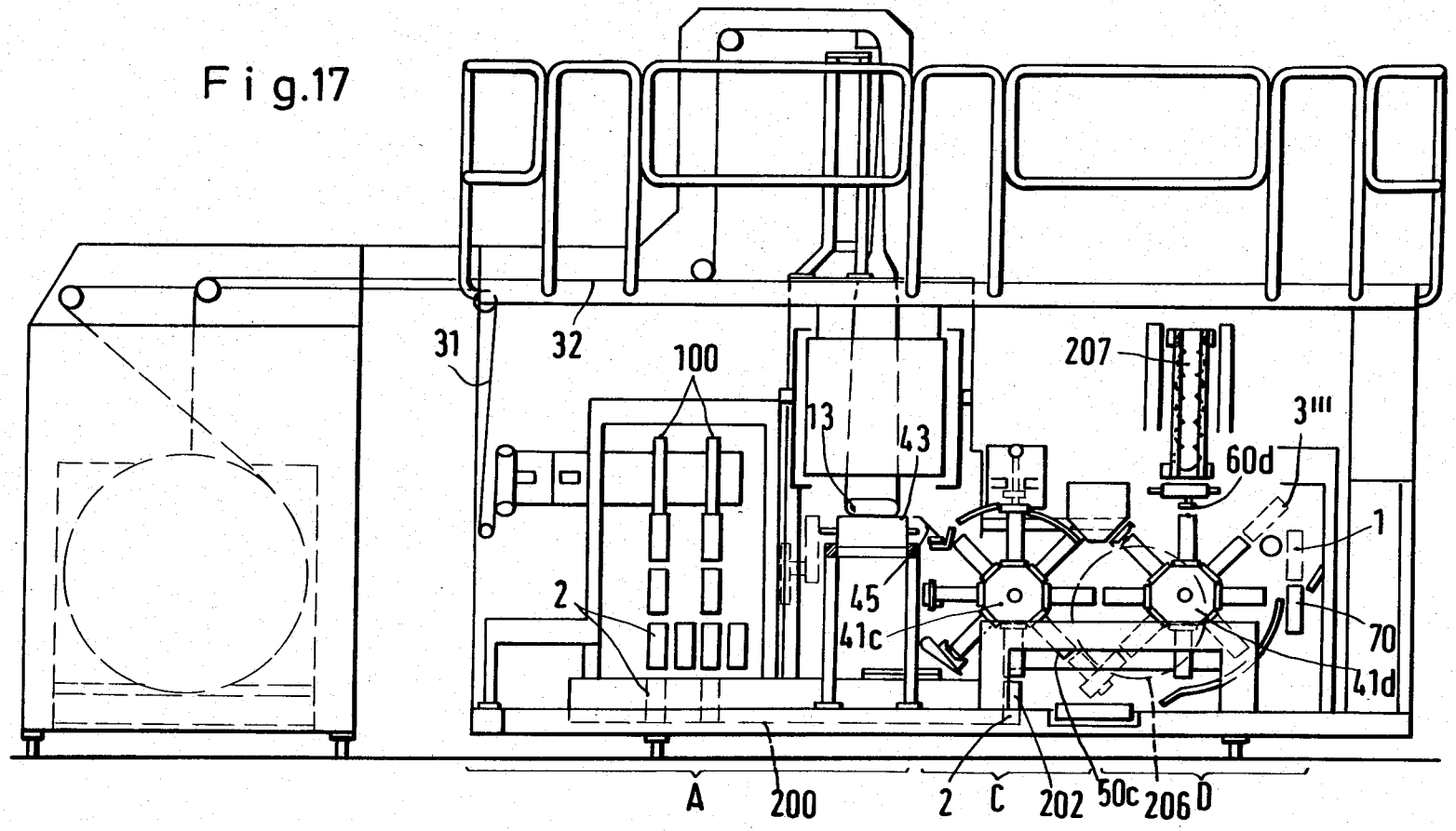
Figure 18:
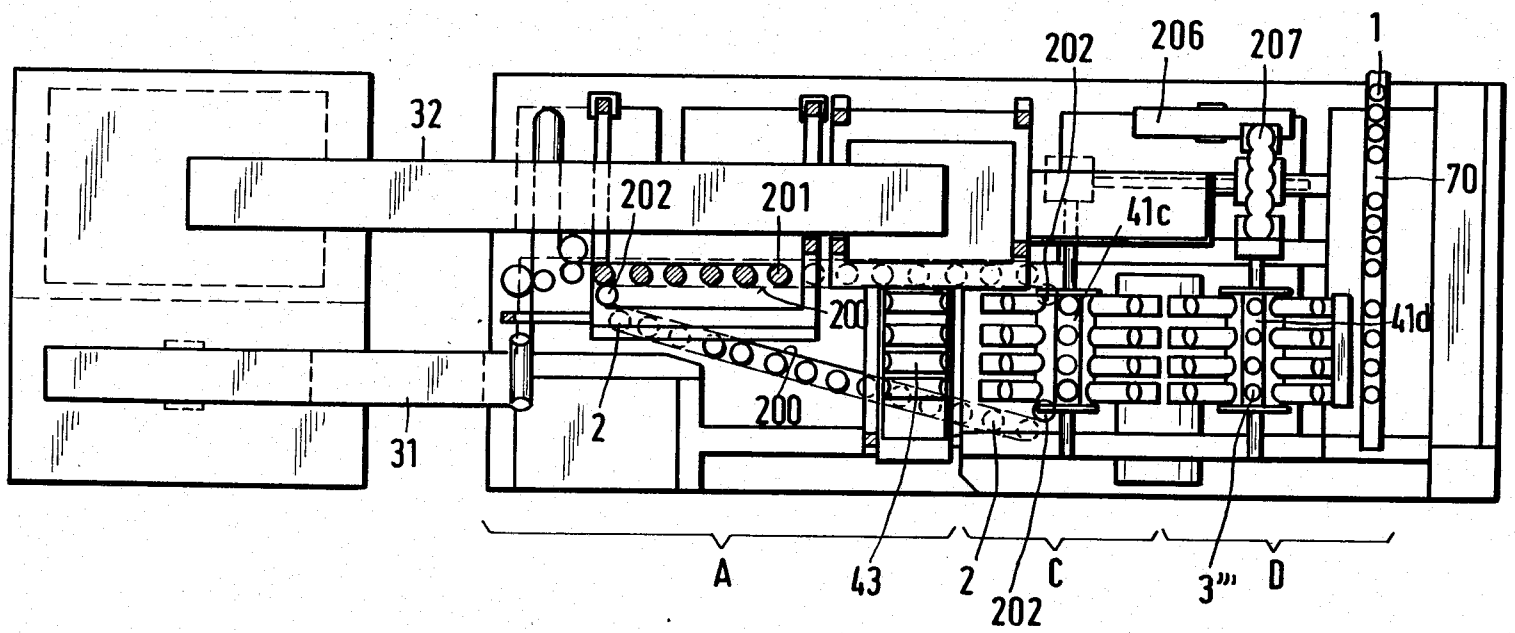

More specifically:

FIG. 2 is a plan view of the whole machine with the second web of material, i.e. the web of sheeting, turned obliquely, FIG. 3 is a partly diagrammatic side view along the line III—III in FIG. 1, showing only those parts which are essential for operation and explanation of the invention, FIG. 4 is a plan view of the FIG. 3 arrangement, looking onto FIG. 3 from right to left, FIG. 5 is a plan view of FIG. 4 corresponding to the line V—V, FIG. 6 is a partly fragmentary and partly sectional view along the line VI—VI in FIG. 4, FIG. 7 is a fragmentary sectional view along the line VII—VII in FIG. 3, FIG. 8 is a view similar to FIG. 7 but showing the final processing state (flanging of the edge), FIG. 9 diagrammatically shows the filled end of the web of sheeting as it goes in between the shaping and welding chains and as the fully welded chain of bags comes out into the trough chain, of which a fragment is shown, FIG. 10 is a fragmentary view similar to the lower part of FIG. 9, illustrating the cutting arrangement and the conveying channels in the right hand part of the trough chain, FIG. 11 is a diagrammatic sectional representation substantially along the line XI—XI in FIG. 10, showing the sucked-in and ejected state, FIG. 12 is a larger-scale representation of the details indicated at the top of FIG. 11 at station O, including the pressure piston and movable jaws, FIG. 13 is a diagrammatic representation similar to FIG. 11, though here the third wheel with external mandrels is shown in one position with the suction piston, in the next position clockwise with the pressure piston and in the successive position in the ejection state, FIG. 14 shows the pack for flowing material which can be made with the machine in question, in the closed, transporting state, FIG. 15 is a plan view of the broken-off upper part of the opened pack, FIG. 16 is a sectional view along the line XVI—XVI in FIG. 14, FIG. 17 is a diagrammatic side view of the whole machine in a different embodiment where the first conveyor is an endless belt, FIG. 18 is a plan view of the machine in FIG. 17, FIG. 19 is a diagrammatic sectional representation similar to FIG. 11 of the embodiment described above, FIG. 20 is a diagrammatic view similar to FIG. 19 and again similar to FIG. 13 of the other embodiment described above, and FIGS. 21(*a*) to (*c*) diagrammatically show three movements made by the endless belt shown in FIGS. 17 and 18.

In FIG. 1 the machine for making liquid bags 1 can be seen in perspective, in a view from the front and top right. The longitudinal direction of the machine is to be taken as going from left to right; this is also the direction of the final processing, particularly the line joining the wheels with external mandrels, still to be described. The housing can be seen as partly broken away to reveal the essential parts of the machine and the relationship between them.

The product of the machine is a liquid pack 1 of the type shown in detail in FIGS. 14 to 16, with a filling bag 13 and a supporting cover 2,3. The cover has cylindrical side walls 2 (piece of tubing) and end portions 3 and 3′ which are joined to the so-called supporting cover tube 2 by flanged edges 4 and 4′. One end portion 3 forms the lid of the liquid pack 1 with a tear-off strip 5, which has a ring pull 6 moulded onto its front end and an inner cover strip 7 with a pouring hole 15 arranged below it. The outer cover or tear-off strip 5 is formed by two parallel incisions 8 in the lid material 3; these end substantially in the centre of the lid 3 and are joined together by folds 12 to form a hinge at the inner end. An incision 11 may alternatively be provided in the centre of the fold 12, similar to the curved incision 9 provided on the opposite side between two short folds 10, so that the ring pull 6 can be placed on the side wall of the tube 2 (FIG. 14) and possibly welded at 24 in the region of the recess 25 below the pouring edge 26. Welding points 21 may be provided on the top of the inner cover strip 7 to hold down the tear-off strip 5.

The construction with the lid 5 and ring pull 6 with the inner cover strip 7 arranged below it can be seen from the section in FIG. 16, where the spacing has been exaggerated for clarity. The cover strip 7 forms the pouring edge 26 towards the front, with the trough-like recess 25 arranged below it as a pouring aid. The figure also shows the hole 15 in the inner cover strip 7 and a welding line 18 encircling the hole, with the sheeting or the bag 13 welded onto the inner cover strip and thus onto the top end portion 3 along the line 18. The centre of the top is sealed directly onto the underface of the lid 3 through the hole 15 in the inner cover strip 7, and it will be appreciated that the web of the bag 13 is continuous and impervious and is only shown diagrammatically as being offset for illustration purposes.

When the user removes the ring pull from the point of attachment 24, takes hold of it and thus moves the tear-off strip 5 from the position in FIGS. 14 and 16 into the position in FIG. 15, the substantially circular part 16 of the bag 13, which is sealed to the inside of the lid 3 within the annular welded area 18, is automatically torn off with the removal of the lid, thus forming a hole 15 as a pouring aperture. The bag 13 nevertheless hangs from the inside of the bag 3 (sic), and the user can now start pouring the contents over the edge 26 without any difficulty.

The pack illustrated in FIG. 14 is shown front right in FIG. 1 in the finished state and is just being conveyed away in the direction of the curved arrow.

The pack 1 is formed from a first web of material 31 comprising plastic coated paper and a second web of material 32 comprising a plastic sheet folded in a V shape; in the FIG. 1 view, for example, the folded edge is shown top left at 33 and the free edges 34 are on the right.

The first storage point 35 for the first web of material is the reel shown from the reverse side in the foreground of FIG. 1, and the second storage point is a zigzag stack (not shown in the drawings) in the housing member 36 adjacent the reel 35. The two webs 31, 32 can consequently be seen from FIGS. 1 and 2, first being drawn upwards from the storage point then, via various direction changing rollers 37 and 37′, drawn forwards in the direction of the arrow 38, parallel with one another and longitudinally of the machine.

Four processing stations A, B, C and D are arranged one behind the other in the direction in which the webs 31, 32 are conveyed. The first station A includes shaping means which will be described in detail later, particularly shaping flaps 40 to form the supporting cover tube 2 (shown separately in a different figure) and a first mandrel wheel 41.

The second processing station B, arranged behind the first, comprises the means for filling the bags shown generally at 13, particularly the shaping and welding chains 42 and the trough chain 43.

The following, third processing station C can be thought of as containing guide channels 45 (not shown in detail until FIG. 10) as means for conveying the product from the trough chain 43 to a second mandrel wheel 41*a*. The third station C also includes suction and clamping means (not shown) for combining the bags 13 with the tubes, located in the external mandrels 50*a*.

At the fourth processing station D the third wheel 41*b* is shown, with external mandrels and with means 60*b* for sealing the cover 2, 3, 3′, also a discharge conveyor 70 which carries away the finished packs 1 at the end of the machine and inverts them to bring the lids to the top. It is followed by conveying chains (not shown) to withdraw the finished packs in the direction of the curved arrow shown at the right hand side of FIG. 1.

Thus the entire construction comprises the four processing stations A to D, which will now be illustrated more specifically in order to explain the details.

First processing station A

The shaft 46 of the first wheel 41 with external mandrels extends transversely to the longitudinal direction 38 of the machine, and the shafts 46*a* and 46*b* of the second wheel 41*a* and third wheel 41*b* are spaced from one another, parallel and arranged in the same horizontal plane, Each wheel 41, 41*a*, 41*b* is octagonal, with the external mandrels 50, 50*a*, 50*b* mounted so as to project radially from the eight intermediate planes. In the direction of the shafts 46, 46*a*, 46*b* all three wheels 41, 41*a*, 41*b* have four external mandrels each 50, 50*a* and 50*b* respectively, spaced one behind the other on each of the eight planes. Thus each wheel carries altogether 32 external mandrels.

One difference between the first wheel 41 and the other two wheels 41*a* and 41*b* is that the first wheel 41 has a mandrel slide 47 displaceable in the direction of the shaft 46. Another difference is that the first wheel 41 does not have special pneumatic means.

The construction of the first processing station A over the first wheel 41 can be seen from FIGS. 3 to 8. A diagrammatic representation of the first mandrel wheel 41 can be seen at the bottom of FIG. 3 and its rotary direction is indicated by the arrow 48. The first station A can be explained more easily in terms of the processing of the first web of material 31 (plastic coated paper), i.e. in a downward direction in FIGS. 1, 3 and 4. After the last direction-changing roller 37 the first web 31 is brought into a plane between a mandrel 100 and the shaping flap 40 (from right to left in FIG. 4). A cutter 101 interacting with a hardened back-pressure plate 102 cuts it into two successive sheets of paper which substantially represent the layout of the piece of tubing at 2. This state can be seen clearly in plan view in FIG. 5, which also shows the paired arrangement of the shaping flaps 40 relative to the mandrels 100. This is the first position I, which is the top position in FIGS. 3 and 4. Below it are positions II to V. The halves of the shaping flaps can be swung around a common shaft 103 which forms a hinge-like connection with a slide 104. The slide can be moved up and down (in a vertical direction), so that the flaps 40 can be brought down from position I into position II and back up into position I, and there is also provision for a smaller movement in a transverse direction. The drive for the slide 104 and flaps 40 is shown somewhat diagrammatically in FIG. 3. The flaps 40 are opened and closed by means of the linkage 105 when the drive rod 106 moves to the left or right about the point of rotation 107 in the direction of the curved arrow 108. On the left hand side, on the drive rod 106 and connected to the linkage 105, one can also see the cam controlled drive 109 which produces the swinging movement of the flaps 40. Rollers 110, 110′ guide the slide 104 in rails (not shown) during the up and down movement.

The mandrel 100 is not expressly shown in FIGS. 3 and 4, but one can see the strip 111 located in the gap at one side of the mandrel 100 and movable in a vertical direction relative to it. The arrangement of the strip is also clear from figures 5 and 6 in a cross-sectional view.

A rubber backing jaw 112 is let into the periphery of the mandrel 100 opposite the movable strip 111. Like the water cooled pressure jaw 113 (FIG. 6), the jaw 112 belongs to the sealing station located in position II and shown in FIG. 6. This operates with hot air streaming out of the slot-shaped nozzle 114. The longitudinal seam of the piece of tubing 2 is formed by this sealing station and the pressure jaws 113 which are movable in the direction of the double arrow 116 by means of supports 115. Applying rods 117, 117′ mounted at the ends of the shaping flaps 40 aid in the process. They press the free edges of the not-yet longitudinally sealed tube 2 onto the mandrel 100, in such a way that the final bringing together of the edges to form the longitudinal seam can be carried out by the pressure jaw 113 with the backing jaw 112.

Preliminary shaping for flanging the lower edge 4 is carried out in position III in FIGS. 3 and 4. It is shown more specifically in FIGS. 7 and 8 and explained with reference to those figures.

Jaws 118 and 119 with a sliding drive are shown in FIG. 4. They are driven movably in the following manner: when the longitudinal seam has been finished and the flaps 40 opened in position II, and when the flaps 40 rise into position I, the jaws move from position 119, up along the broken line arrow 120 into position 119′, so that when the flaps 40 have come together in position 1 and the slide 104 moves downwards, the tube 2 will be drawn down from position II to position III. The tubes are similarly drawn down intermittently from position III to position IV, at the bottom of which the end of the mandrel 100 is located. The bottom level 121 is reproduced on a larger scale in FIG. 7.

In FIG. 7 one can see the flanging tool made up of the member 122 and that shown generally at 123. The operative parts of the tool are the flanging ring 124 and the supporting member 125. Both can be moved vertically up and down because they are joined flexibly to the external support 123 by means of a resilient ring 126 vulcanised onto the metal parts. FIG. 7 also shows a recess 25′ in the mandrel 100, which can be thought of as having a projection from a horizontally reciprocating piston opposite it on the outside. Instead of the piston with the projection only the holder shown generally at 123 and the applying lining 127 are shown in the section chosen here.

Where FIG. 7 shows the state prior to flanging, FIG. 8 shows the final state when the annular edge 4 has already been formed on the tube 2. Due to this inwardly projecting edge 4, the tube 2 cannot be drawn onto an internal mandrel and for this reason the wheels 41, 41*a*, 41*b* have external mandrels 50, 50*a*, 50*b*. Here they are hollow mandrels with appropriate internal dimensions to receive the tubes 2 and are termed "external mandrels" in this specification.

However, before the further processing of the tubes 2 is followed the production of the filling bag must first be described.

Second processing station B

This station contains means for producing filled bags made from the second web of material, i.e. a web of plastics sheeting laid double; the web is shown at 32 in FIGS. 1 and 2 and has cover portions 3, 3′ sealed onto two diametrically opposed ends.

The second web of material 32, which is first conveyed in the longitudinal direction 38 of the machine, is diverted vertically upwards by a direction changing roller 130 (FIG. 1) into the upper part of the entire machine, when it meets a second direction changing roller 131. The shafts of the two rollers 130, 131 are in horizontal planes spaced vertically one above the other, but the spindle of the upper roller 131 is set at an angle $\alpha$ of 45° to that of the roller 130. This produces the angle $\alpha$ shown in FIG. 2 and causes the web 32 to be brought forwards at 45° from the rear part of the entire machine (at the top in FIG. 2) into the front part, in front of the mandrel wheels 41, 41*a*, 41*b*. In the embodiment shown here the last part of the unfilled tube, open at one side, runs vertically downwards. It is advanced by belt conveyors 133 engaging in pairs adjacent the fold 33. The bottom drive gear thereof entrains a pressure wheel 135 by way of a spindle 134. Opposite the wheel 135 (not shown in FIG. 1) is another pressure wheel which runs so as to squeeze and solidify the longitudinal seam freshly made by the hot air nozzle 136 (lengthwise sealing station).

Over the station 136 the filling pipe 137 leads into the still-open slit between the edges 34 of the web 32; it extends to below the supporting control ring 138 where it ends in a filling jet.

Below the filling station are two shaping and welding chains 42 with opposing pairs of links, operating generally vertically as will be seen clearly from FIGS. 1 and 9. The supporting ring 138 gives the web a round cross section, and two further supporting belts 140, 140' bring it together in a V shape, so that the part of the web leaving the belts 140, 140' so to speak flows into and completely fills the tubular cavity 141 formed by the particular halves 142 of the cavity mould then present. The fact that the links of the chains 42 advance in opposing pairs produces a plurality or a series of tubular cavities 141. The first cavity 141 is in the open position, and somewhat further is the next cavity down 141, which in FIG. 9 is shown closed like the others below it. These cavities 141 determine the filling volume of each particular bag 13.

Unspecified welding jaws 143 interact with opposing backing jaws 144 to form transverse seams in the web 32, shown at 145 at the bottom of FIG. 9.

A trough chain 43 which can be seen in FIGS. 9 and 10 is arranged under the chains 42 as a transversely distributing conveyor. The trough chain is endless and is guided substantially horizontally about two horizontal, spaced spindles 146. The troughs 147 are each made up of two trough-shaping portions 148, two of which can be seen separately in FIG. 10 to the left and right of the gears of the direction-changing belt. Between the troughs and in the central upper part of the shaping members 148 there is a recess 150 for the cutter 151 of the cutting unit shown generally at 152.

The troughs 147 are relatively wide, so the bags 13 come into an oval shape when they lie freely in them. This means that there is a wide spacing between successive troughs 147, with the advantage that there is more freedom to construct downstream units.

The second processing station B ends with the trough chain 43, with the separated and filled bags 13 lying on it parallel, so that the line from the lid 3 to the base 3' is in the longitudinal direction 38 of the machine.

(The trough chain 43 travels round continuously, and ejecting means (not shown) with clamping devices push four bags 13 at a time into the guide channels 45, which are shown at the next processing station C.)

Third processing station C

At processing station C there are conveying means in the form of guide channels 45 with means for joining the bag 13 with the tube 2, including the second mandrel wheel **41*b***.

The distance between the guide channels 45 at the inlet side (shown at the top of FIG. 10) is smaller than that at the outlet end shown below. The distance between the bags 13, which are still relatively close to one another on the trough chain 43, is therefore extended towards the second wheel **41*a*** with external mandrels.

The second and third wheels **41*a*, 41*b*** have unspecified pneumatic means for generating high and low pressure.

FIGS. 11 and 13 show apertures **49*a*, 49*b* associated with each of the eight flat surfaces, so that each of the eight stages can have high or low pressure applied to it. The low pressure regions 161 and high pressure regions 162 should, for example, be noted. The flowing material which fills the bag 13 is shown at 163. It has already been mentioned that all the wheels 41, 41*a*, 41*b* carry four external mandrels 50, 51*a*, 50*b* on each working surface in the direction of their shafts 46, 46*a*, 46*b*. Welding on devices defined generally as 60*a* and 60*b* are arranged in the 12 o'clock position of the second wheel 41*a* and also of the third wheel 41*b* (e.g. mandrel position O in FIG. 11). A vertically arranged pressure piston 165, adapted to move in a straight line and controlled by the cam plate 166, can be seen from FIGS. 11 and 12**.

A further cam plate 167 moves hot jaws 169 engaging round the top edge 4 of the piece of tube 2, by means of arms 168. The jaws can be moved apart in the direction of the curved arrows 170 or brought together into the position shown in FIG. 12, according to the control. So the jaws 169 do not form a true seal with the heat passing through webs of paper; instead they only warm the layers of plastic on the top annular edge 4 and the corresponding lower annular peripheral surfaces of the lid 3, then move away in the direction of the arrows 170 (FIG. 12), after which the pressure piston 165 forms the final connection. The counter pressure to the piston 165 is provided by the stiffness of the material of the tube 2.

The second wheel with external mandrels turns clockwise to the right as shown in FIG. 11, and a pressure finger 171 is indicated diagrammatically in the next position to the right of the top position O; this can press down the ring pull 6 in the manner indicated (see curved arrow 172).

Fourth processing station D

At this station the third wheel **41*b* is arranged to rotate in the same direction, and means (not shown) are provided to convey a tube 2 closed at one end from FIG. 11 to FIG. 13 in the direction of the arrow 173, from the second wheel 41*a* to a mandrel 50*b* on the third wheel 41*b***.

The suction means 174 is shown in FIG. 13, in the form of a suction piston which can move in the direction of the double arrow 175 and thereby raise the end portion 3' (base) out of the cavity within the edge 4' into the positions in FIG. 13. The means **60*b* for welding on the end portion appears again in the next position; the piece of tube 2 is completely sealed in it by a procedure similar to that shown in FIG. 12**.

In operation the machine takes the first web 31 to the FIG. 5 position, severs it by means of the cutters 101 and wraps it round the mandrel 100 by means of the shaping flaps 40.

Together with the flaps 40 the slide 104 moves out of position I into position II (FIGS. 3 and 4), so that the hot air from the nozzle 114 activates the lengthwise seam (FIG. 6) and longitudinal sealing is carried out by the movement of the pressure jaw 113 in the direction of the double arrow 116, first towards the opposing jaws 112. When the flaps have been opened and raised, the jaws 118 with a sliding drive move the piece of tube 2 with the finished lengthwise seam into position I, and when the flaps move back down into position II during clamping means for joining the bags 13 to the tubes 2 located on external mandrels 201 on the endless belt 200.

At the fourth processing station D the so-called third wheel 41*d* with external mandrels is again shown, with sealing means 60*d* for the cover 2 and end portions 3, 3''' and with a discharge conveyor 70. The conveyor 70 carries away the finished packs 1 at the end of the machine and processes them further, as already described above in connection with the first embodiment.

Endless belt at first processing station A

Instead of the first wheel 41 in the other embodiment described above, the first conveyor to receive the pieces of tubing 2 in FIGS. 17 and 18 is an endless conveyor belt 200 travelling around vertical shafts 202, with holders or external mandrels 201 fixed to it at equal spacings. The spacing between alternate mandrels 201 is equal to that between the two mandrels 100 shown at the top of FIG. 17.

In the plan view in FIG. 18 three vertical shafts 202 can be seen, with the endless belt 200 extending round them and substantially following a triangular shape. The upper leg shown in FIG. 18 runs below the mandrels 100; the hypotenuse then conveys the external mandrels 201 carrying the tubes 2 into the so-called second mandrel 41*c* in station C for transfer from the belt 200 to te external mandrel 50*c* of the wheel 41*c*; and in FIG. 18 back to the starting point along the other leg, which runs parallel with and along the second wheel 41*c*.

The cycle of the endless belt 200 takes place in steps of 1–3, 1–3 etc., as will now be explained with reference to FIG. 21. In the three steps of the movement (a), (b) and (c) in FIG. 21 the two lower mandrels 100 at level 121 are both shown in the top line, and the outer mandrels 201 of the endless belt 200 are indicated in the line below. While the mandrels 100 are stationary to make the tubes 2, the endless belt 200 moves in the direction of the arrow 203. The individual external mandrels 201 are shown at a, b, c, d, etc. in FIG. 21.

Figure 21:
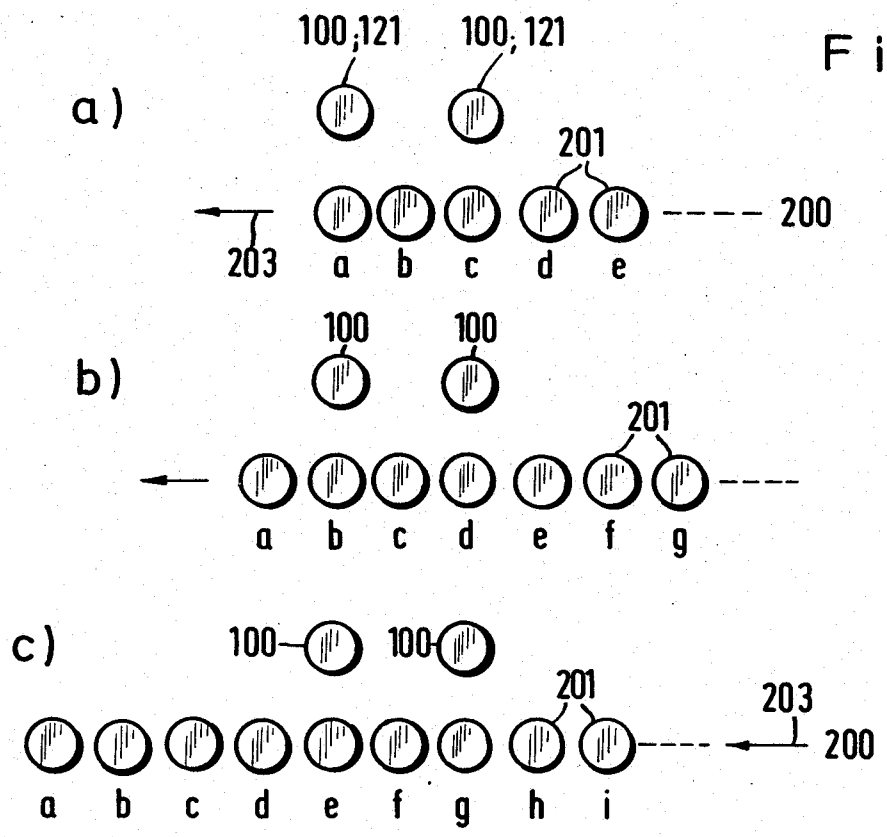

In operation the empty external mandrels a, b, c, d, e etc. first stand under the mandrels 100 provided with tubes in state (a) in FIG. 21. More precisely, the external mandrels a and c stand opposite the mandrels 100 to receive the tubes 2. The transfer of tubes takes place (not shown).

In the state shown in FIG. 21*b* there are already tubes on the external mandrels a and c, and there are again new tubes on the stationary mandrels 100 for delivery to the next external mandrels. These next mandrels b and d are therefore opposite the stationary mandrels 100, because the belt 200 has moved forwards one unit from state (a) to state (b). Tubes can now again be transferred from mandrel 100 to mandrel b and d.

When the belt 200 advances three more units state (c) in FIG. 21 is reached. Here the external mandrels a, b, c and d are each provided with a tube and mandrels e, f, g, h, i are still free. We are back at the initial state shown in FIG. 21*a*, except that now the mandrels e and g are opposite the stationary mandrels 100, whereas in FIG. 21*a* the tubes 2 were transferred to mandrels a and c.

This concludes the explanation of the 1–3 cycle of the endless belt 200.

When the tube 2 in station C has been guided under the lower mandrel 50*c* of the second wheel 41*c* and raised on that mandrel 50*c* the tube 2 and bag 13 are joined as in FIGS. 11 and 13 of the first embodiment.

The difference between FIGS. 11 and 13 and FIGS. 19 and 20 is that in the second embodiment now to be described the bag 13 is only provided with a cover portion 3 at one end.

Figures 19, 20:
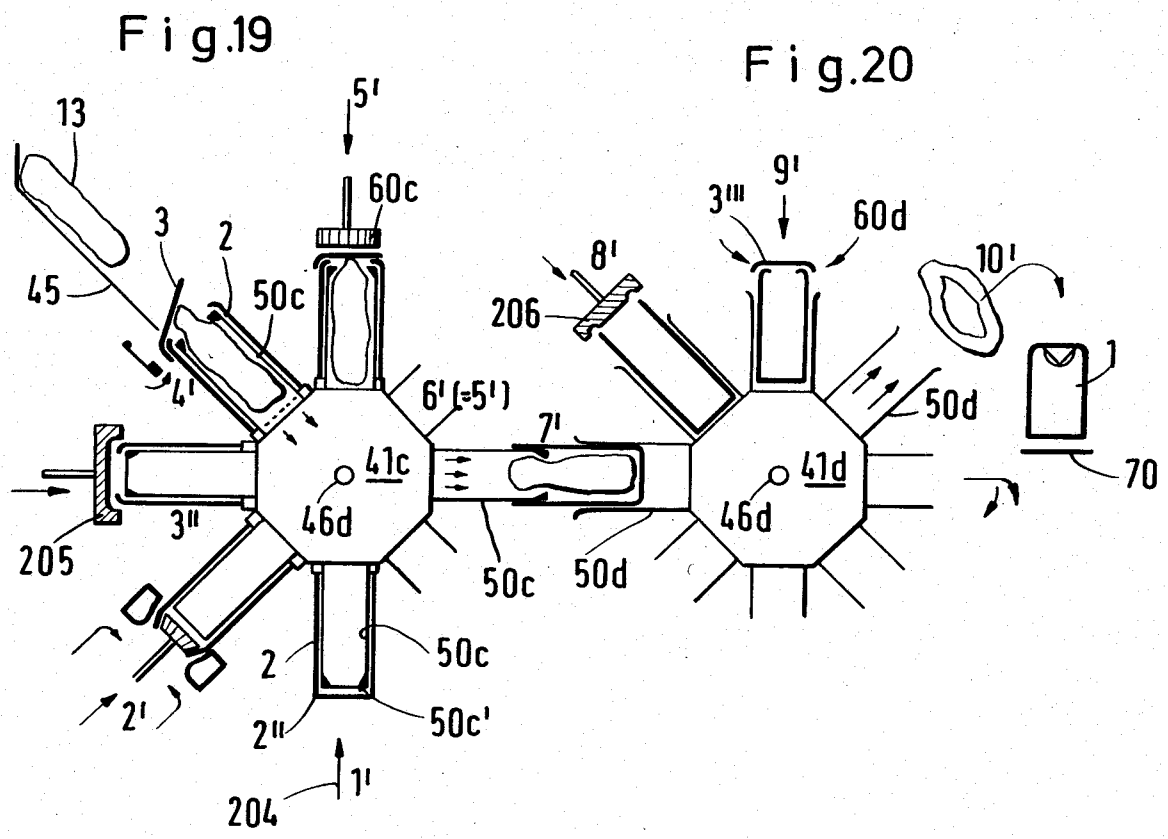

FIG. 19 shows the processing station C containing the guide channels 45 as the transporting means. They are similar in construction to the embodiment described above, so no further explanation is necessary. In the second embodiment too the second and third wheels 41*c* and 41*d* have pneumatic means (not shown in detail) for generating high and low pressure in the manner described above. The appropriate openings and connections for the flowing material are not shown here. The construction of the wheels is similar to that of wheels 41*a* and 41*b* in the first embodiment. Welding means defined generally as 60*c* and 60*d* are arranged at the 12 o'clock position of the second wheel 41*c* and also of the third wheel 41*d* (e.g. mandrel position 0 in FIG. 11). The cam control operates as described in conjunction with FIGS. 11 and 13.

Operation of the second embodiment

When the second embodiment of the machine is in operation and the tube 2 has been transferred to the lower mandrel 50*c* of the second wheel 41*c* in the direction of the arrow 204, the state 1' is reached, with the tube 2 open at both ends.

The external mandrel 50*c* will be seen to have a thin cylindrical wall, e.g. from 1/10 mm to 5/10 mm thick, and the free edge 50*c'* of the wall is provided with a thickened rim. In position 1' in FIG. 19 the external annular edge 2'' of the tube 2 projects beyond the thickened free annular edge 50*c'*.

Since both wheels 41*c* and 41*d* turn clockwise, the tube 2 is next switched to state 2'. Here the free annular edge 2'' is preshaped by internal and external tools movable in the direction of the arrows.

When the tube has been switched on into position 3'' it is turned up to form a flange by flanging means 205. On being switched to position 4' the bag 13 comes into the space inside the mandrel 50*c* in the same way as in the embodiment described above, but with two differences: firstly the bag is only provided with one cover portion 3 at one end, and secondly the external mandrel 50*c* is itself located between the bag 13 and the tube 2.

When the tube has been switched to position 5' the cover portion 3 is sealed by the welding means 60*c*. After movement to position 6' there is no further processing, so a final state virtually the same as at position 5' is maintained here. In position 7' the tube 2 is ejected with the bag 3 inside it, closed at one end in the manner described in connection with FIG. 11 in the 3 o'clock position.

In position 7' the tube is transferred from the second wheel 41*c* to the third wheel 41*d* shown in FIG. 20. When it has moved to position 8' the other sharp circular edge of the tube is flanged by a groove forming tool 206.

In position 9' one can already see the flanged circular edge, with a different cover portion 3''' being sealed onto it in known manner.

The new cover portion 3''' comes from a supply reel 206 indicated in FIGS. 17 and 18. A continuous strip 207 with the new cover portions is unwound from it, divided up and moved into the positions over the third mandrel wheel 41*d*. There the cover portions 3''' are the next cycle they move it down into position III. Shaping prior to flanging takes place at the lower end of position III, and flanging is finally effected at the bottom of position IV as shown in FIGS. 7 and 8. The flanging ring 124 turns in the free lower edge to form the edge 4 shown in FIG. 8. The recess 25 (FIGS. 14 to 16) is also pressed in at one point.

When the piece of cover tube 2 thus has the edge 4 at the bottom it is pushed back by means of the jaws 118 from position IV shown in FIGS. 3 and 4 to bottom position V, i.e. into an external mandrel 50 of the first wheel 41. The wheel 41 turns anti-clockwise in the direction of the arrow 48, to flange the opposite edge 4' in a similar way at one of the next switching stages in a manner not shown. Otherwise no further processing takes place until the four successive tubes are turned into the 3 o'clock position of the first wheel 41. The technically quite simple process of transferring the prepared tube 2 to the second wheel 41*a* is then carried out, again in a manner not shown.

In the meantime the filled bag 13 must be made ready to be joined to the tube. For this purpose the second web of material described, the web of sheeting 32 provided with the end portions 3, 3', is unwound and guided into the correct angular position via the direction changing rollers 130 and 131. One end portion 3, which will later be the lid, is sealed onto the sheeting 32 (sealing surface 16, 18) together with the inner cover strip 7 (FIGS. 14 to 16). As shown in FIG. 1, the web 32 first moves over the filling pipe 137 and then externally around the pipe into the longitudinal sealing station 136, where a lengthwise seam is formed by hot air and the squeeze rollers 135. The liquid level is below it, i.e. in the region where the seam is cooled and solid, substantially in the region of or below the supporting control ring 138. By means of the ring and by means of the conveyor belts 133 the web 32 is drawn further down between the shaping and welding chains 42, in which tubular cavities 141 are formed and completely filled by the corresponding parts of the web. If sealing is effected between the half shells or cavity shape halves 142 during the vertical downward movement with the main surface of the shaping and welding chains 42, to form the transverse seams 145, then the chain of successive filling bags 13 will be obtained as shown at the bottom of FIG. 9.

The cutter 151 of the cutting unit shown generally at 152 in FIG. 10 enters the recess 150, severs the filling bags 13 and leaves them lying in broad troughs 147 of the chain 43.

We shall now go back to FIG. 11 and look at the 11 o'clock position of the second whell 41*a* as a view in section along the line XI—XI in FIG. 10. The bag 13 filled with liquid 163 can be seen here, with the base portion 3' welded to its front end and the lid portion 3 welded to its rear end. A clamping means (not shown) should be thought of as holding the lid 3 in position to prevent the bag 13 from turning around its own longitudinal axis.

The second wheel 41*a* controls its pneumatic means so that the apertures 49*a* are switched to suction in the 11 o'clock position, producing the low pressure 161 in that cavity in the external mandrel 50*a*. In this way the bag 13, which has already been pushed about halfway into the mandrel 50*a*, is drawn in still further and in a favourable way by the action of the low pressure 161 and fills the cavity inside the tube 2. It does not matter if the base portion 3' is still in the same position in the rim 4' as in the 12 o'clock and 2 o'clock positions. The first priority is for the lid 3 to be laid flat on the top edge 4 in a favourable manner, as shown in the 12 o'clock position, also shown at 0 at the top. The ring pull 6 projects over the edge to the right, although in FIG. 12 it happens to project to the left. The hot jaws 169 warm the plastic surfaces to be activated, then move away in the direction of the arrows 170, after which the pressure piston 165 presses the lid 3 onto the edge 4.

When the second wheel 41*a* has turned into the next position, the 2 o'clock one, the pressure finger 171 moves against the ring pull 6 in the direction of the curved arrow 172 and seals it to the previously activated location at 24.

When the first wheel 41*a* has moved into the 3 o'clock position, compressed air 162 is forced through the apertures 49*a* into the space below the base portion 3' within the mandrel 50*a*. In this way and/or by other conveying means (not shown) the liquid pack closed at one end is guided in the direction of the arrow 173 to the third wheel 41*b*, i.e. into the opposing aligned mandrel 50*b*.

During the next cycle this is turned to the 11 o'clock position, in which a suction piston 174 enters the open end of the tube 2 as indicated by the double arrow 175, engages the end portion 3' and pulls it out into the position shown in FIG. 13. The suction air is then turned off and the third wheel 41*b* moves the series of external mandrels 50*b* described to the 12 o'clock position. Here sealing is effected with the welding station 60*b*, as explained in connection with FIG. 12. The now completely sealed pack does have an almost 100% full bag 13, but there are small volumes of air between the cover and the bag. When the pack is opened in the manner described at the beginning, the liquid level therefore drops immediately after opening and the liquid is prevented from spilling.

On leaving the 12 o'clock position the third wheel 41*b* turns the row of packs in question to the 2 o'clock position. High pressure 162 is generated through the apertures 49*b* and the finished pack can be ejected, in such a way that it is lifted over the discharge conveyor 70 (FIG. 1) and inverted downwardly onto a further conveyor (not shown) with the lid at the top and the base of the pack at the bottom.

In FIG. 17 one is looking onto a machine similar to FIG. 1 from front left to back right, that is to say, FIG. 17 is a side view of the whole machine, although it is a different embodiment of the machine, namely the one with the endless belt as the first conveyor. The successive processing stations are again shown in the direction in which the webs 31, 32 are conveyed, but here only stations A, C and D are of interest. The first processing station A includes the shaping means already described above, particularly the flaps 40 to form the piece of tube 2, as described in connection with the first embodiment. The particularly important feature of station A is the use of the endless belt 200 as the so-called first conveyor.

The means for filling the bags 13, comprising the shaping and welding chains 42 and the trough chain 43, will not be described again here since they are similar to those in the first embodiment.

In the third processing station C downstream thereof guide channels 45 (not shown), as described above, are provided as means of transport from the trough chain 43 to a so-called second mandrel wheel 41*c*. The third processing station C further comprises suction and shown spaced from one another in the left hand third of processing station D in FIG. 18.

The cover portions preferably comprise a circular plastic disc with highly elastic properties. For example linear polythene which has large expansion values can be used as the material for the cover portion 3'''. This provides a way of increasing the volume, should the finished pack, sealed on all sides, be knocked or struck. If the pack is knocked or struck the inner bag knocks against the outer cover and can provide a reserve volume if the very elastic plastic is used, so that the pack does not burst. The pastic disc 3''' can in fact expand. In this way an impact-proof pack is obtained.

The pack 1, which is sealed on all sides in position 9' of the third wheel 41*d*, is discharged at position 10' as shown at the top right hand side of FIG. 13. The finished pack 1 is expelled by air onto the discharge conveyor 70, where it is carried away.

We claim:

1. A machine for the preparation of packages for flowable material, said packages having a fillable inner bag disposed within an outside supporting cover, said machine comprising:

(a) a first processing station comprising means adapted for the sequential preparation of a plurality of single, separated, tubular-shaped outside supporting covers from a first web of material, said first processing station further including a first conveying means for transporting said supporting covers;

(b) a second processing station comprising means adapted for the sequential preparation of a plurality of individual, adjacent filled bags from a second web of material, said means further comprising a longitudinal sealing station, a filling pipe, shaping and welding chains downstream from said filling pipe, detachment means and discharge means, said second processing station further including a second conveying means to transport said fillable bags;

(c) a third processing station comprising means adapted to receive said supporting covers and said fillable bags, and means for joining of a fillable bag with a supporting cover to form a package, said joining means comprising:

(i) a mandrel wheel for receiving said covers, (ii) at least two adjacent guide channels arranged transversely to the conveying direction of said second conveying means and inclined to the horizontal, and wherein the spacing between said channels is smaller at the inlet than the outlet for feeding said bags into said covers, and (iii) a second wheel for receiving said formed packages from said first wheel having a plurality of external mandrels and provided with pneumatic means to generate raised or lowered pressures within at least one of the mandrels; and (d) a fourth processing station comprising means for sealing the supporting cover of the package formed in step (c).

2. The machine of claim 1, further characterized in that (a) the material of the first web comprises a paper, coated on at least one side with a plastic, and mounted on a reel, and (b) the material of the second web comprises double laid plastic sheeting, stored in the form of a zigzag stack, with cover portions sealed onto at least one end thereof.

3. The machine of claim 1, further characterized in that the preparation means of the first processing station includes shaping flaps capable of engaging around a mandrel and a sealing station comprising a plurality of edge flanging stations, and further, external mandrels disposed on wheels.

4. The machine of claim 3, further characterized in that as seen in the direction in which the first web is conveyed, there is provided cutters for detaching flat pieces of web material adjacent to a first position of shaping flaps, which are movably mounted on some means allowing said shaping flaps to move from said first position to at least a second position and return; sealing stations adjacent to said second position and operated by some means such as the provision of hot air; a movable flanging tool arranged in a further position downstream; and, a stationary mandrel extending from at least the second position to the position of the flanging tool.

5. The machine of claim 4, further characterized in that a recess is provided on the periphery of the stationary mandrel which cooperates with the shaping means to form the supporting cover such that the packages will be provided with a pouring edge.

6. The machine of claim 1, wherein the first conveying means for transporting said supporting covers is a mandrel wheel.

7. The machine of claim 1, further characterized in that a plurality of components operate in parallel to provide a plurality of supporting covers to the first conveying means.

8. The machine of claim 7, further characterized in that a first mandrel wheel is provided with at least two external mandrels axially displaceable on a mandrel slide on each working surface in the direction of its shaft.

9. The machine of claim 1, further characterized in that the preparation means of the second processing station includes at least two direction changing rollers set at an angle of between approximately 30° to approximately 60° to one another.

10. The machine of claim 9, further characterized in that the angle of said direction changing rollers is approximately 45°.

11. The machine of claim 9, further characterized in that the spindles of said direction changing rollers are each in the same horizontal plane, and the filling pipe and the opposing shaping and welding chains of the preparation means interact in pairs to form a series of tube-shaped cavities which are disposed in a substantially vertical direction above the horizontal plane of the shafts of mandrel wheels comprising the second-conveying means.

12. The machine of claim 1, further characterized in that the preparation means of said second processing station is further provided with a control ring which supports the second web, said control ring is stationarily positioned between the sealing station and the shaping and welding chains within the second web of material, further, said control ring surrounds said filling pipe.

13. The machine of claim 1, further characterized in that the second conveying means of the second processing station is a transversely distributing conveyor in the form of an endless trough chain guided substantially horizontally around two spaced horizontal shafts, and further provided with cutting means disposed between troughs to detach the bags.

14. The machine of claim 13, further characterized in that discharge means are provided which act transversely to the conveying direction of the trough chain.

15. The machine of claim 14, wherein said discharge means are provided by clamping devices.

16. The machine of claim 2, further characterized in that a welding means is provided for welding the cover portions of the second web to one end of the supporting covers.

17. The machine of claim 16, wherein the welding means comprises a pressure piston and adjacent hot pressure jaws movable substantially transversely to the direction movement of said piston, said piston and jaws being adapted to engage the outer free end of a mandrel at the topmost position of its rotation on the mandrel wheel.

18. The machine of claim 1, further characterized in that the fourth processing station comprises:

(a) a mandrel wheel;

(b) means to transfer the packages formed in the third processing station from the mandrel wheel of the third processing station to the above-mentioned mandrel wheel; and, (c) a second welding means adapted to seal the remaining end of the package, wherein said mandrel wheel is disposed adjacent to the mandrel wheel of the third processing station, has the same number of mandrels, a parallel wheel shaft and the same rotary direction.

19. The machine of claim 18, further characterized in that the mandrel wheel is provided with pneumatic means to generate raised or lower pressures within at least one of the mandrels, and said fourth processing station is further provided with a discharge conveyor disposed along the side of the mandrel wheel opposite the mandrel wheel of the third processing station.

20. The machine of claim 1, further characterized in that the first conveying means of the first processing station is an endless belt moving around verticle shafts and adapted to receive supporting covers and advance by one unit.

21. The machine of claim 20, wherein the first conveying means is adapted to advance by three units.

22. The machine of claim 1, wherein the mandrels of the mandrel wheel of the third processing station are each provided with a thin cylindrical wall to receive a filled bag internally and a supporting cover externally, said cylindrical wall having a thickend rim at its free end.

23. The machine of claim 1, further characterized in that the third processing station includes means for flanging the outer annular edge of each supporting cover and means for welding thereon a second cover portion.

24. The machine of claim 1, further characterized in that the fourth processing station includes means for flanging the outer annular edge of each supporting cover and means for welding thereon a second cover portion.

* * * * *